US007703631B2

(12) United States Patent
Chafe et al.

(10) Patent No.: US 7,703,631 B2
(45) Date of Patent: Apr. 27, 2010

(54) CONTAINER

(75) Inventors: Adam J. Chafe, Hudson, OH (US); Stuart F. Bedford, Hudson, OH (US); Kenneth W. Erdmann, Chagrin Falls, OH (US); James E. MacDonald, Medina, OH (US); Dilip R. Tamhane, Avon Lake, OH (US); Oliver J. Ramsey, Brunswick, OH (US); Ronald D. Hudas, Massillon, OH (US); Charlie Watling, Raleigh, NC (US); Forrest A. Burney, Raleigh, NC (US); Bob Bruno, Avon, CT (US); Scott Belliveau, Plainfield, IL (US)

(73) Assignee: The Sherwin-Williams Company, Cleveland, OH (US)

( * ) Notice: Subject to any disclaimer, the term of this patent is extended or adjusted under 35 U.S.C. 154(b) by 764 days.

(21) Appl. No.: 11/029,980

(22) Filed: Jan. 5, 2005

(65) Prior Publication Data

US 2005/0269327 A1 Dec. 8, 2005

Related U.S. Application Data

(60) Provisional application No. 60/573,175, filed on May 21, 2004, provisional application No. 60/613,876, filed on Sep. 28, 2004, provisional application No. 60/614,220, filed on Sep. 29, 2004.

(51) Int. Cl.
*B05C 21/00* (2006.01)

(52) U.S. Cl. ..... 220/570; 15/257.06

(58) Field of Classification Search ..... 220/570, 220/571, 571.1, 697, 702, 735, 736; 206/508; 15/257.01, 257.06

See application file for complete search history.

(56) References Cited

U.S. PATENT DOCUMENTS

| | | | | |
|---|---|---|---|---|
| 1,554,824 | A | 9/1925 | Knoblock | |
| 2,275,305 | A | 3/1942 | Morgan | |
| 2,659,096 | A | 11/1953 | Mencfeldowski, Jr. | 15/121.2 |
| 2,659,917 | A * | 11/1953 | Drum | 15/257.06 |
| 2,723,410 | A | 11/1955 | Sprung et al. | 15/121.2 |

(Continued)

FOREIGN PATENT DOCUMENTS

EP 0153059 A1 8/1985

(Continued)

OTHER PUBLICATIONS

PCT International Search Report, Int'l. App. No. PCT/US2005/000222, International Filing Date May 1, 2005.

*Primary Examiner*—Harry A Grosso
(74) *Attorney, Agent, or Firm*—Arthi K. Tirey; Robert E. McDonald; Eryn Ace Fuhrer

(57) ABSTRACT

The present invention is directed toward a novel container system that is designed to hold and store liquids, such as for example, paints, stains, and various other coatings. The container system generally includes a base member, a shelf that is contained within the base member, and a lid. The shelf is provided with the base member and is designed to accept an application device, such as for example a paint roller. A lid is also provided with the container so that a fluid may be provided and stored as part of an all-inclusive delivery system.

89 Claims, 21 Drawing Sheets

U.S. PATENT DOCUMENTS

| | | | | | |
|---|---|---|---|---|---|
| 2,827,648 | A | | 3/1958 | Geisz | |
| 2,893,030 | A | | 7/1959 | Averna | |
| 2,911,663 | A | | 11/1959 | Geary | 15/121.2 |
| 3,091,793 | A | | 6/1963 | Bentley, Jr. | 15/257.06 |
| 3,110,921 | A | * | 11/1963 | Conner | 15/257.06 |
| 3,139,188 | A | * | 6/1964 | Goetz et al. | 211/133.6 |
| 3,289,881 | A | * | 12/1966 | Ganung | 220/254.1 |
| 3,536,187 | A | | 10/1970 | Stafford | 206/15.1 |
| 3,553,762 | A | | 1/1971 | Padgett, Jr. et al. | |
| 3,576,045 | A | | 4/1971 | Stafford | |
| 3,602,939 | A | * | 9/1971 | Schoenholz | 15/257.06 |
| 3,756,451 | A | | 9/1973 | Popeil | |
| 3,761,995 | A | * | 10/1973 | Rinard | 15/257.06 |
| 3,828,389 | A | | 8/1974 | Heisler | 15/257.06 |
| 3,940,824 | A | | 3/1976 | Gioia et al. | 15/257.06 |
| D264,147 | S | | 5/1982 | Heath | D4/38.2 |
| 4,416,392 | A | * | 11/1983 | Smith | 221/45 |
| 4,445,250 | A | | 5/1984 | Seidl | |
| 4,491,234 | A | | 1/1985 | Wilcock | |
| 4,547,926 | A | | 10/1985 | Kern | 15/257.06 |
| 4,651,379 | A | | 3/1987 | Kern | 15/257 |
| 4,691,838 | A | | 9/1987 | Graham et al. | 220/93 |
| 4,865,282 | A | | 9/1989 | Yonkman et al. | |
| 4,928,843 | A | | 5/1990 | Gunderson | 220/90 |
| 5,046,749 | A | * | 9/1991 | Owens | 280/79.5 |
| 5,085,317 | A | | 2/1992 | Jensen et al. | 206/229 |
| 5,251,979 | A | | 10/1993 | Larsen | |
| 5,283,928 | A | | 2/1994 | Linn et al. | 15/257 |
| 5,314,061 | A | | 5/1994 | Bedrossian | 206/229 |
| 5,316,137 | A | | 5/1994 | Kyllonen | 206/209 |
| 5,335,806 | A | | 8/1994 | Dedoes | |
| 5,341,969 | A | | 8/1994 | Accardo et al. | 222/465.1 |
| D355,287 | S | | 2/1995 | Camp, Jr. | D32/53.1 |
| 5,400,916 | A | | 3/1995 | Weber | 220/404 |
| 5,404,611 | A | | 4/1995 | Raney | 15/257 |
| 5,472,111 | A | | 12/1995 | Renfrew | 220/570 |
| 5,533,228 | A | | 7/1996 | Jarecki et al. | 15/257.06 |
| 5,546,628 | A | | 8/1996 | Silvera | |
| 5,553,701 | A | | 9/1996 | Jarecki et al. | 206/15.2 |
| 5,566,861 | A | | 10/1996 | Serano | |
| 5,660,302 | A | | 8/1997 | Trout | 220/790 |
| 5,727,708 | A | | 3/1998 | Erickson | |
| 5,810,196 | A | | 9/1998 | Lundy | 220/736 |
| 5,855,304 | A | | 1/1999 | Dean et al. | 222/481 |
| 5,941,410 | A | | 8/1999 | Mangano | 220/735 |
| 5,960,946 | A | | 10/1999 | Gramlich | 206/209 |
| 5,966,772 | A | | 10/1999 | Woodnorth et al. | 15/230.11 |
| 6,102,235 | A | | 8/2000 | Stern et al. | 220/212 |
| 6,105,813 | A | | 8/2000 | Abbey | 220/570 |
| 6,119,303 | A | | 9/2000 | Passafiume | 15/257.06 |
| 6,199,718 | B1 | | 3/2001 | Ellis | 220/735 |
| 6,237,799 | B1 | | 5/2001 | Emerson | 220/480 |
| 6,305,045 | B1 | | 10/2001 | Walsh et al. | |
| 6,419,106 | B1 | | 7/2002 | Bebak | |
| 6,543,635 | B2 | | 4/2003 | Ciccone | 220/276 |
| 6,622,884 | B1 | | 9/2003 | Gartner | 220/570 |
| D518,263 | S | * | 3/2006 | Verhaar | D32/53.1 |
| 7,207,466 | B2 | * | 4/2007 | Walsh et al. | 222/111 |
| 2002/0056714 | A1 | | 5/2002 | Schinkel | |
| 2002/0096527 | A1 | | 7/2002 | Arenas et al. | |
| 2003/0012887 | A1 | | 1/2003 | Orlikowski | 427/428 |
| 2003/0160051 | A1 | | 8/2003 | Ciccone | 220/276 |
| 2003/0197014 | A1 | | 10/2003 | Muchin et al. | 220/318 |
| 2004/0195267 | A1 | | 10/2004 | Dean et al. | |
| 2004/0222226 | A1 | | 11/2004 | Gottainer et al. | 220/284 |
| 2004/0226958 | A1 | | 11/2004 | Robellard et al. | |
| 2005/0017012 | A1 | | 1/2005 | Hodge | 220/501 |
| 2005/0098564 | A1 | | 5/2005 | Verbrugge et al. | |

FOREIGN PATENT DOCUMENTS

| | | | |
|---|---|---|---|
| EP | 0151876 | B1 | 4/1989 |
| EP | 0144135 | B1 | 3/1992 |
| EP | 0402 370 | B1 | 5/1993 |
| WO | WO 89/07532 | | 8/1989 |
| WO | WO 99/22946 | | 5/1999 |
| WO | WO 02/074633 | A2 | 9/2002 |
| WO | WO 03/078179 | A1 | 9/2003 |
| WO | WO 2004/030937 | | 4/2004 |

* cited by examiner

CONTAINER

CROSS-REFERENCE TO RELATED APPLICATIONS

This application claims the benefit of U.S. Provisional Application No. 60/573,175, filed May 21, 2004, U.S. Provisional Application No. 60/613,876, filed Sep. 28, 2004, and U.S. Provisional Application No. 60/614,220, filed Sep. 29, 2004, of which the entirety of each application is hereby incorporated by reference.

BACKGROUND

The present invention is a novel container that includes an applicator shelf. The container is practical for use with any fluids that might by applied by roller, including, for example, paints, stains, water repellants, adhesives, or sizing. The shelf allows for distribution of a fluid that could be contained in the base member onto an applicator. The shelf additionally provides for drainage of excess fluid from the applicator and from the shelf itself. The container also includes a lid, which is locked onto the base member of the container during initial transportation and storage of the container. Additives, such as colorants, catalysts, biocides, or other materials, could be added by removing the lid, adding the desired additive, and then resealing the lid, or they could be added into the container through a resealable additive hole, such as an additive hole that contains a plug, that can be incorporated into the topside of the lid. If a resealable additive hole is incorporated into the lid, it is not necessary to disengage the lid from the base member to incorporate the additive. Thus, the lid could remain locked onto the base member to prevent accidental removal of the lid. The lid is removable by the consumer such as by disengagement of a tear-off strip. The tear-off strip serves as one locking mechanism by which the lid is engaged onto the base member. Even after the tear-off strip is removed, a second locking mechanism can serve to engage the lid onto the base member so that any materials remaining in the container can be stored in the container until needed. The container also includes a handle, such as a wire bail or plastic handle, for easy transport. One useful application of the container is for containing coatings such as paints or stains.

Because the shelf of the present invention is contained entirely within the base member, one problem that is typically encountered with conventional roller trays is resolved; namely, an instance where paint or other material must be poured from its container into a well of a conventional roller tray, thereby creating unwanted mess and waste. The container also reduces the mess and waste at the end of a job where paint or other material remains in the well of the conventional roller tray. Since the base member of the present invention itself contains the paint or other material and a shelf to be used for a particular project, it is also unnecessary for a consumer to purchase a separate roller tray.

SUMMARY OF THE INVENTION

The present invention is directed to a container. One object of the present invention is to provide a container to store, provide access to, and dispense liquids. In one embodiment, the container includes a base member, and the base member further includes a well that comprises a floor and a back wall, a first sidewall, a front wall and a second sidewall. The container of this embodiment includes a lid and also includes a shelf that is housed within the base member.

The shelf of this embodiment includes a top surface, and an underside also includes and at least one hole through the shelf. In an alternative embodiment, the shelf can be constructed with a continuous surface without any holes therethrough. The shelf is adapted to receive an applicator, such as a paint roller. The shelf may include at least one hole, and alternatively a plurality of holes, to provide for drainage of excess fluid from the application. In this embodiment, the shelf may also include one or more ribs to assist in the dispersion of the fluid onto the applicator.

The shelf of this embodiment includes a novel integrated pouring spout. Through use of the spout, the user may transfer fluid that is contained in the base member into a separate container cleanly and easily. In one embodiment the pouring spout is an upward projection including at least one sidewall. In an alternative embodiment, the pouring spout is an upward projection including at least two adjacent sidewalls.

In one embodiment, the lid includes an opening therethrough. The opening can include a removable plug that is affixed into the opening. The plug may, for example, be removed in order to introduce an additive to the fluid contained in the container without removing the lid, and is used to reseal the additive hole.

In an alternative embodiment, the container also includes a handle.

Another embodiment of this invention provides for a shelf that can be used as an applicator surface to assist in the distribution of a fluid onto an applicator. One such applicator that can be used in accordance with this embodiment is a paint roller. The shelf is positioned within a container to allow for drainage of excess fluid into the container. In one embodiment, the shelf includes an integrated pouring spout. The pouring spout can be an upward projection, and includes at least one sidewall.

Yet another embodiment of this invention provides for a process of mixing an additive into a fluid contained in a container. The process of this embodiment includes providing a container, where the container further includes a fluid and a shelf suspended over a portion of the fluid; providing a lid that is affixed onto the container, where the lid includes a lid opening that houses a resealable plug; adding an additive to the container through the lid opening; and affixing the plug into the lid opening. The process of this embodiment also includes agitating the container.

Another embodiment of this invention provides for a process of mixing a colorant in a container. The process of this embodiment includes providing a container; providing a lid that is affixed onto the container, where the lid includes a lid opening that houses a resealable plug; adding colorant to the container through the lid opening; and affixing the plug into the lid opening. The container further includes paint and a paint roller shelf that is suspended over at least a portion of the paint. The process of this embodiment also includes agitating the container.

Yet another embodiment of the present invention provides for a process of applying paint to a roller. The process of this embodiment includes providing a container with an opening into a fluid storage area; and providing a shelf suspended over the fluid storage area. The shelf of this embodiment includes an integrated pouring spout.

Another embodiment of this invention provides for an adapter to be used during agitation of the container. The adapter is placed on the surface of a lid of a container and bears the force of a pressure plate of a mixer. The adapter is designed to receive downward force from the pressure plate and apply that force evenly and uniformly on the container lid to keep the lid in place during agitation.

BRIEF DESCRIPTION OF THE DRAWINGS

It will be appreciated that the illustrated boundaries of elements (e.g., boxes or groups of boxes) in the figures represent one example of the boundaries. One of ordinary skill in the art will appreciate that one element may be designed as multiple elements or that multiple elements may be designed as one element.

Further, in the accompanying drawings and description that follow, like parts are indicated throughout the drawings and description with the same reference numerals, respectively. The figures are not drawn to scale and the proportions of certain parts may have been exaggerated for convenience of illustration.

DETAILED DESCRIPTION OF ILLUSTRATED EMBODIMENTS

Figure 1:
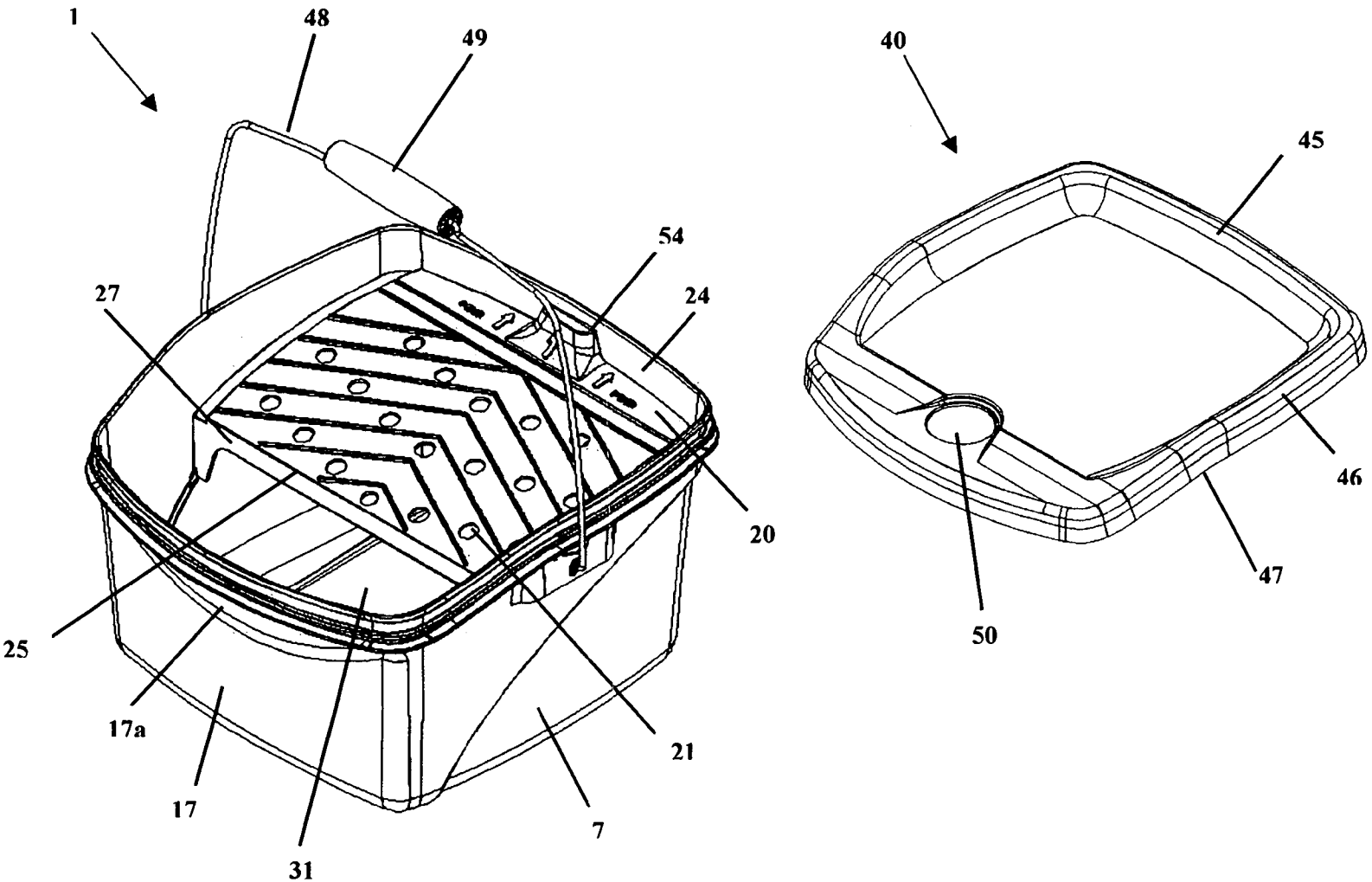
FIG. 1 is an exploded view of a container as described herein, said container including a base member with a shelf contained therein and a lid.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Unless otherwise indicated, as used herein, the terms "about" and "approximately" mean±10%.

As used herein the term "paint container" shall representatively describe the container as described. However, it should be appreciated that the container can house any variety of fluids, including but not limited to paints, stains, water repellants, adhesives, or sizing.

In one embodiment, this disclosure relates to an inclusive delivery system that provides a user with a fluid, a integrated shelf, and a lid in an easy-to-transport, easy-to-use, and easy-to-access container. In another useful embodiment, the delivery system contains paint and the shelf acts as a roller tray that provides for easy drainage and removal of excess paint into the reservoir of the container.

Referring first to FIG. 1, the container includes a base member indicated generally at 1, a shelf, or applicator surface, indicated generally at 20, and a lid indicated generally at 40. The container also includes a fluid, and in one embodiment, includes paint, that is housed within the base member and sold with the container as an all-inclusive system. Any quantity of fluid may be included in accordance with the container as described herein. The quantity of fluid that may be placed in the container will be dictated by the size of the base member, and conversely, the size of the base member may be modified subject to the quantity of fluid desired to be contained therein. In one embodiment, the container will house approximately 2.5 gallons of paint. The components of the container, namely the base member, lid, and shelf can each individually be made from any practical materials, including plastics such as polycarbonate, polypropylene, or polyethylene. The components of the container, in one useful embodiment, are constructed from high-density polyethylene (HDPE).

The base member acts as a reservoir from which paint is collected by a roller, and into which surplus paint drains through holes 21 in the shelf. The holes in the shelf not only provide for drainage of excess paint, but the holes also allow for ample color dispersion after colorant is introduced into the container and the container is placed into a paint shaker. In this way, the subject paint container can be sold with paint, which can later be colored based on user specifications. A lid is placed onto the base member and "locked" to ensure that it does not dislodge during shaking, and the lid is not required to be removed in order to introduce a colorant due to the presence of an additive hole through which a colorant is added. Thus, a paint container system is provided.

Figure 2:
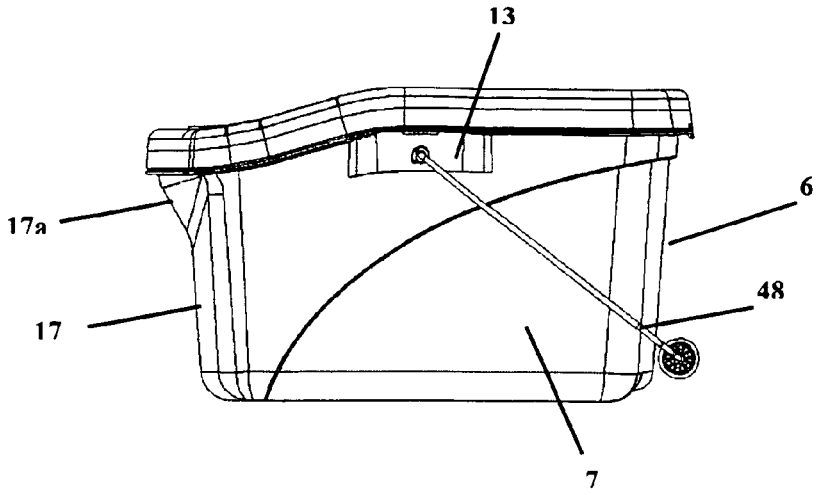
FIG. 2 is a side view of a container as described herein.
Figure 3:
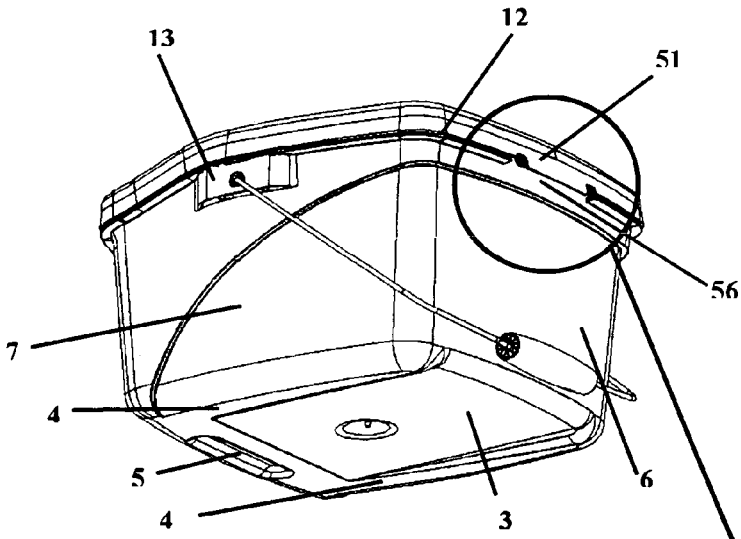
FIG. 3 is a perspective view of the container, specifically the back and side of the container.
Figure 4:
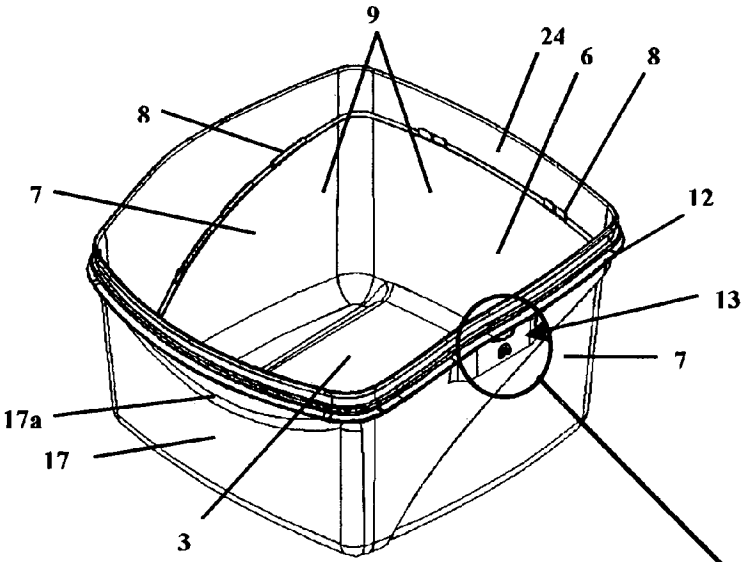
FIG. 4 is a perspective view of the base member with the lid, shelf, and wire handle removed.

As best shown in FIGS. 2, 3 and 4, the base member of the container of the instant invention comprises two side walls 7 spaced from each other, and a front wall 17 spaced from a back wall 6, and a floor 3, and contains a predetermined quantity of fluid therein. In one embodiment, the upper portion of the front wall of the base member is outwardly rounded to form a lip 17*a*. A rounded lip provides more clearance for an applicator to be inserted into the base member to access the fluid composition. In an alternative embodiment, the front wall need not be rounded.

Though the base member can be of any shape, in one useful embodiment, the base member is generally non-cylindrical. Although shown herein as having a generally rectangular footprint, the container, e.g., base member, and lid, may have other shapes. For example, the container could be any non-cylindrical shape. Likewise, the container can be any cylindrical shape, such as generally round or elliptical. In a case where the container is a cylindrical shape, the base member may have only one continuous, e.g., circumferential, sidewall rather than the more than one sidewall as illustrated herein.

The base member can be tapered slightly from top to bottom, thereby more easily allowing nesting of multiple base members during storage and warehousing prior to assembly of the lid and shelf therein. Additionally, the tapering of the base member provides a smaller footprint for the container, allowing one filled and lidded container to be stacked upon one another, while being nested within the lid of the container beneath it, such as in a store display. In this manner, stacked containers are less likely to slide off or be pushed off of one another during storage.

In one embodiment, the bottom of the base member measures a width of about 10.91 inches. The width of the top of the base member is about 12.75 inches, from side wall to side wall. A handle 48 is pivotally mounted to ears 13 that appear on the sidewalls 7. In this embodiment, the width of the base member as measured from one ear to the opposing ear is about 13.09 inches, and the length of the base member, from the front wall to the back wall is about 11.10 inches, as measured from the bottom of front wall to the bottom of the back wall. However, the length of the base member, as measured from the lip of the base member to the back wall of the base member is about 13.26 inches due to the outwardly rounded lip of this embodiment. A lid 40 (see FIG. 1) is also provided for engagement onto the base member. With the lid engaged onto the base member, the length of the base member, as measured from the front of the lid (proximal to the lip) the back of the lid (proximal to the back wall) is about 13.43 inches. In this embodiment, the height of the container with the lid engaged, as measured along the front wall from the bottom of the base member to the top of the lid, is about 6.69 inches. The height of the container with the lid engaged, as measured along the back wall from the bottom of the base member to the top of the lid, is about 7.69 inches.

The central portion of the floor 3 of the base member is sloped slightly downward toward the front wall 17 of the base member. The slope of the central portion of the floor is greater than 90° but less than 180° relative to the x-axis. This slope directs the paint or other liquid toward the front of the base member where an access opening 31 is provided (see FIG. 1). The side edges 4 of the floor remain flat and do not slope in order to keep the container stable and flat when placed on a surface during use, storage, or shaking in a paint mixer.

In an alternative embodiment, the bottom surface of the side edges of the floor may include anti-skid ribs or grips, or other material that produces friction between the underside of the side edges and the surface upon which the container is placed. In yet another embodiment, the underside of the base member may, include casters or other mechanisms that allow the base member to be easily rolled, slid, or otherwise moved from area to area. Such a feature is particularly useful when the user wishes to transport the container from one area of a room or home without lifting the container while the container fully or partially contains a paint or other composition.

Figure 6:
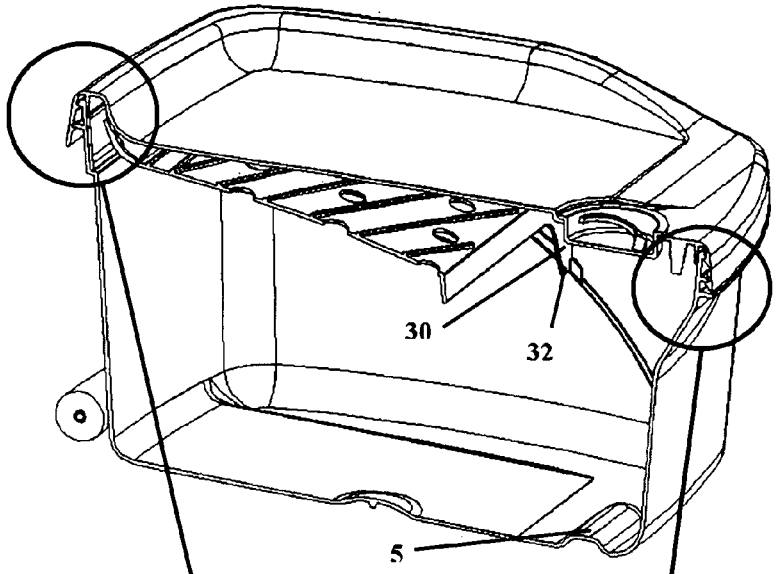
FIG. 6 is a cross-sectional view of the container, fully assembled as herein representatively described.

In one embodiment, the underside of the base member includes a recessed finger grip 5. As best shown in FIGS. 3 and 6, the finger grip is located on the underside of the base member proximal to the front wall of the base member. The finger grip allows a user easier access and ability to move the container, such as for example, off of a store shelf. The finger grip may also be used to assist the user in tipping the base member in order to pour paint out of the base member through a pouring spout. The tipping finger grip allows the user to pour from the container without lifting the entire container off of the floor or other surface upon which the container is resting. It is desirable, therefore, that the finger grip is located opposite to a pouring spout or other region from which the fluid may be poured. Furthermore, a finger grip allows the user a means to stabilize the container with one hand while holding the container by the wire handle with the other hand. When multiple containers are stacked atop one another, the tipping finger grip is easily accessible without lifting a container off of the one beneath it.

In an alternative embodiment, the base member may include a recessed tipping finger grip that is located along the lower portion of the back wall. Again, the finger grip of this embodiment provides an easy means for the user to tilt the container if the user chooses to direct fluid toward the front of the base member for easier access to the fluid by an applicator, such as a paint roller, or if the user wishes to pour the fluid from the front or front corners of the container. In one useful embodiment, a spout is formed one the wall of the base member that is opposite to the finger grip.

The recess that forms the finger grip 5 may be formed at various depths, such as to accommodate a user's fingertips or a greater portion of the user's fingers. For example, in an instance where the finger grip may be formed along the back wall of the base member, it may be desirable to have a finger grip that is deeper, in order to accommodate a larger area of the user's fingers, such as up to a user's knuckles. However, if the finger grip is placed proximate to the area of the base member to which paint is directed, it may be more desirable to have a shallow recess, such as to accommodate a user's fingertips, so that paint may easily flow toward that end of the base member without being interrupted by an intrusive finger grip.

As shown in FIGS. 1, 7-10, and 26 and 28, one useful embodiment may include a pouring spout 54 that is integrated with a shelf. The shelf and integrated pouring spout are more fully described below. In an alternative embodiment, the base member may contain a pouring spout that is formed into a wall of the base member. For example, a pouring spout may be formed from the lip 17*a* of the base member.

Figure 6A:
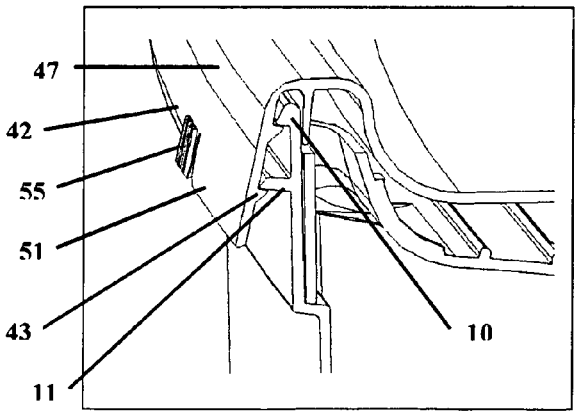
FIG. 6*a* is a cross-sectional view of the lid as engaged onto the base member, proximal to the lid tab.
Figure 6B:
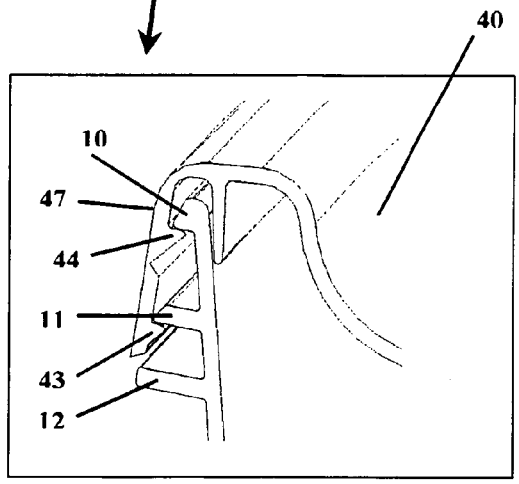
FIG. 6*b* is a cross-sectional view of the lid as engaged onto the base member, proximal to a lower ring.

As seen in FIGS. 6*a* and 6*b*, the outside upper periphery of the base member includes two parallel satellite rings in order to allow engagement of the lid 40. The parallel satellite rings include an upper ring 10 and a middle ring 11. The middle ring 11 locks onto the lower protruding rim of the lid 43, and the upper ring 10 locks onto the upper protruding rim 44 of the lid. Thus, the middle ring and upper ring serve to engage and lock the lid 43 onto the base member. The lid 40 can be removed by detaching a tear-off strip 42 that comprises a portion of the lid. The tear-off strip mechanism is more fully described below and in U.S. Pat. No. 6,543,635, which is hereby incorporated in its entirety by reference thereto. U.S. Pat. No. 6,543,635 also describes the means by which the lid of the container described herein attaches and "locks" onto the base member.

In one embodiment, the upper periphery of the base member also includes a lower ring 12. The lower ring 12 abuts the bottom edge of the lid sidewall 47 when the lid is engaged onto the base member (see FIG. 6*b*). The abutment of the bottom edge of the lid sidewall 47 adjacent to the lower ring prevents snagging through contact with the lid sidewall and it also deters the user from picking up or guiding the container by the bottom edge of the lid sidewall, thereby minimizing accidental removal of the lid.

Figure 3A:
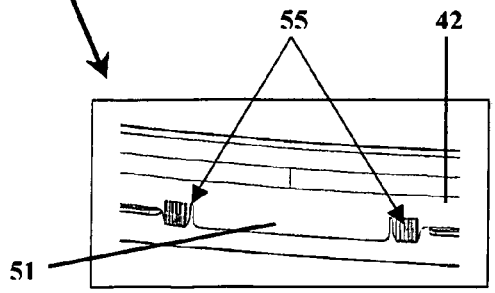
FIG. 3*a* illustrates the lid tab and tear-off strip, with the tear-off attached to the lid.

The lower ring is present around substantially the entire periphery of the base member (as seen in FIG. 6*b*); however, in one embodiment, the lower ring is not present proximal to the lid tab 51 (as seen in FIG. 6*a*), thereby creating a lifting groove 56 to allow a user's fingers to slid behind the lift tab in order to remove the lid (see FIGS. 3 and 3*a*). Though the lower ring may be designed around the entire periphery of the base member, one advantage of not placing the lower ring proximal to the lid tab is that the lifting groove provides easier access for the user to grip and apply upward force on the lid tab in order to remove the lid. As can best been seen in FIG. 3, the area created where the lower ring is not present (for example, where a lifting groove 56 may be positioned) offers easier access for a user's fingers to reach the lid tab.

Figure 5:
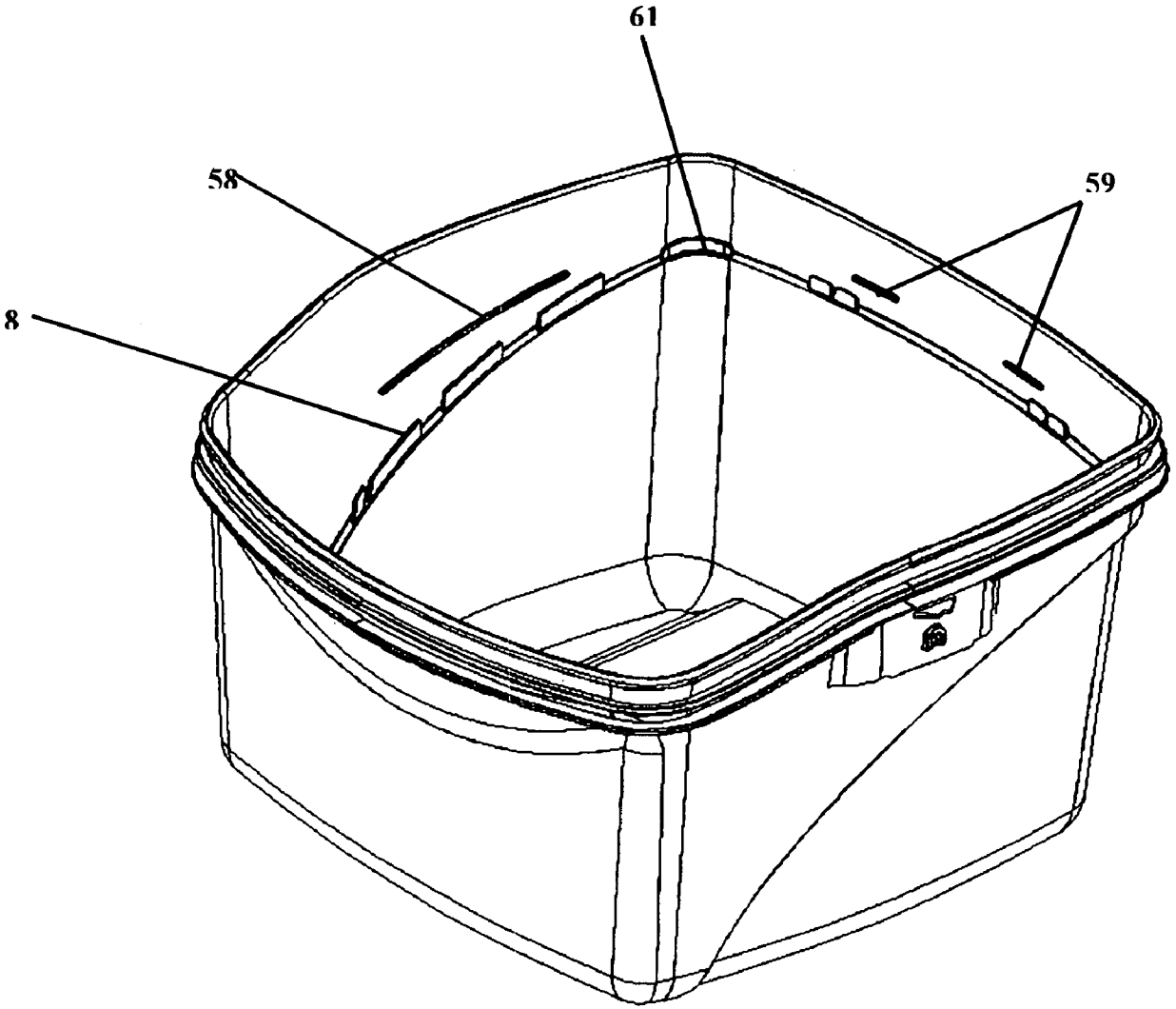
FIG. 5 is a perspective view of the base member with the lid, shelf, and wire handle removed.

As also best shown in FIGS. 1 and 3, a portion of the back wall 6 and sidewalls 7 of the base member are recessed. A shelf could be placed on the recessed area to suspend the shelf over the fluid and within the container. Alternatively, as depicted in FIGS. 4 and 5, the interior walls of the recesses may include one or more shelf retention tabs 8 on the upper rim of the recess 9 to latch onto the side lips 28 and back lip 29 (FIGS. 6, 7, and 8) of the shelf and keep the shelf in place during transport, use, and storage. The interior corners of the base member, where the backwall meets each sidewall, may, alternatively, also include a corner shelf retention tab 61. The side lips of the shelf fit between the side surface of the side shelf retention tabs and the sidewall of the base member. The back lip of the shelf fits between the side surface of a shelf retention tab located on the backwall and the backwall of the base member. As seen in FIG. 6, a shelf retention tab could include a notch 32, within which a foot 30 of the shelf is engaged in order to prevent the shelf from moving or being dislodged during use or transport of the base member, and agitation of the container during dispersion of an additive that could be introduced to the fluid contained therein. In one useful embodiment, the notch is placed on the opposing front most retention tabs located along the sidewall of the base member. In one embodiment, the shelf retention tabs (FIG. 4) that appear along the back wall are at a depth of about 1.48 inches as measured from the top edge of the upper ring. The corner shelf retention tabs are also at a depth of about 1.48 inches as measured from the top edge of the upper ring. As such, when the shelf is inserted into the shelf retention tabs, the shelf is retained entirely within the base member and the approximately 1.48 inch portion of the top of the back wall serves to stop the movement of a paint roller beyond the boundary of the base member and acts as a splash guard 24.

In addition to the shelf retention tabs, one embodiment of the subject invention includes at least one shelf retention segment. As shown in FIG. 5, the shelf retention segments may be placed on one or both interior sidewalls and/or the interior of the backwall. Thus, the base member may include one or more sidewall retention segments 58, one or more backwall retention segments 59, or a combination thereof. The retention segments are located such that once the roller shelf is affixed onto the shelf retention tabs, the retention segments are proximal to the top surface of the sides and/or back of the roller shelf. In one embodiment, the retention segments are in contact with the top surface of the roller shelf. The retention segments are constructed to act as a means for preventing the roller shelf from dislodging from upward force that may be applied on the roller shelf, such as by the movement of fluid in the base member during agitation. The retention segments may be of any length and may be provided on the sidewalls or backwall in any number of segments. The roller shelf, once affixed onto the shelf retention tabs 8, is directed under the retention segments so as to be held in place by the retention tabs and retention segments.

Though the height of the base member may be equal with respect to each wall of the base member, in one useful embodiment, the top edge of the base member slopes downward as it approaches the front wall of the base member. This can be seen in FIG. 2. For example, in one embodiment, the height of the front of the base member as measured along the front wall from the bottom of the base member to the upper edge of the upper ring 10 is about 6.51 inches (see FIGS. 6*a* and 6*b*). However, the height of the back of the base member as measured along the back wall from the bottom of the base member to the upper edge of the upper ring 10 is about 7.51 inches. The shape of the lid 40 is contoured to be complementary to the shape of the top of the base member. Several advantages may be reaped from the feature of a downward sloping top edge of the base member. One such advantage is that the slope provides for easier removal of multiple stacked containers by making it easier to slide containers off of one another, such as in a store display. Another advantage is that when multiple containers are stacked, the slope allows for a space between the lid of one container and the bottom of the container that is stacked upon it. The space allows a user enough clearance to place a hand beneath the front of a container even when it is stacked atop another container, in order to guide or hold the container or access the finger grip on the underside of the base member. Yet another advantage of including a slope on the top of the base member is that it results in a reduction in headspace.

A coating composition, such as paint, may be deposited into the container prior to engaging and locking the lid 40 onto the base member. In one useful embodiment, the container is sold with the paint, coating composition, or other desired fluid product already in the container.

Figure 4A:
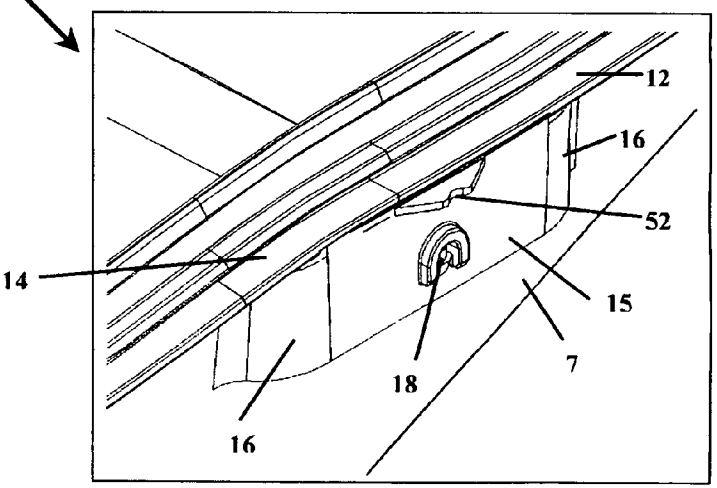
FIG. 4*a* is a perspective view of a bail hole and bail groove into which a handle can be inserted.
Figure 15A:
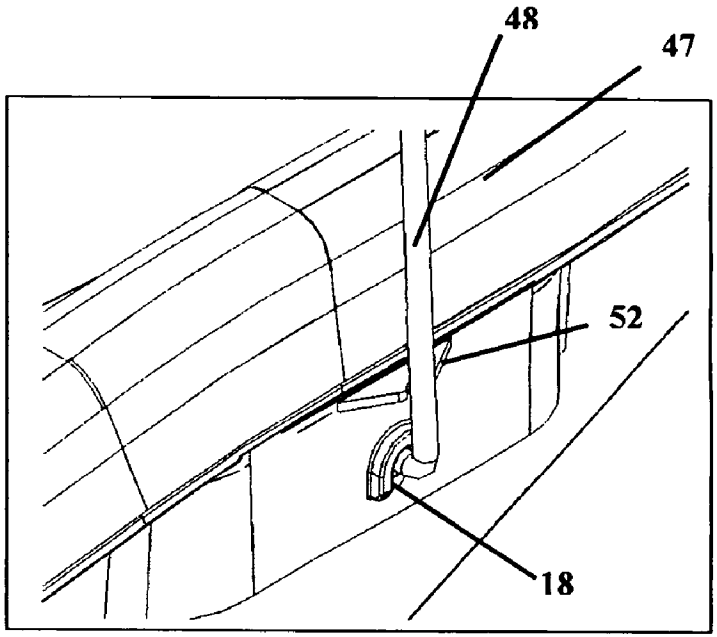
FIG. 15*a* is a perspective view of a bail handle as inserted into the bail hole and engaged with the bail groove.

A handle, such as a wire bail handle 48, may be attached to the sidewalls 7 of the container through two ears 13 that appear on the sidewalls. As shown in FIG. 4*a*, each ear includes a top rectangular wall 14 that is current with and extends from the lower ring 12 of the base member and joins into an integrally formed depending outer transverse ear wall 15; opposed integrally formed side walls 16 connect the ear wall 15 to the outside of the base member side wall 7 to retain the ear substantially parallel to the base member sidewall 7. In one embodiment, the ear wall 15 may also include a lip along the lower portion of the ear wall. Such lip may assist in preventing stacked base members from leaning or falling over prior to assembly of the container by maintaining uniformity of the stack. A bail hole 18 is provided in each ear for attachment of a wire handle 48. In one embodiment, a bail groove 52 is placed on the ear walls, extending from the outer transverse ear wall, to house the wire handle in an upright position (see FIG. 15*a*), for example when the user is carrying the container to minimize the container from swaying back and forth due to movement of the liquid contained therein.

Figure 15:
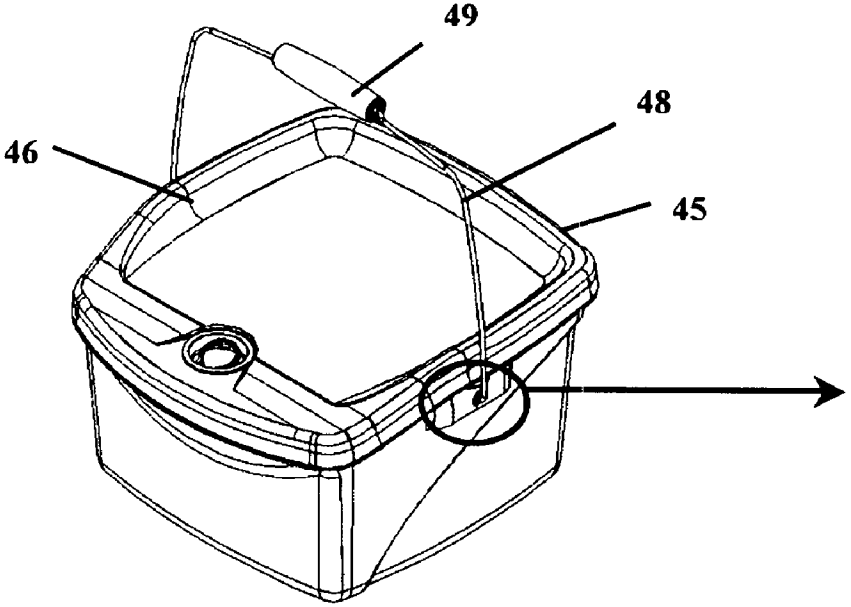
FIG. 15 is a perspective view of a fully assembled container as described herein.

The wire bail handle includes a free-moving molded plastic contoured grip 49 (FIGS. 1 and 15) to allow the user a comfortable grip on the handle during transportation. The free-movement of the grip provides for stability of the container while the user is carrying it despite the movement of the liquid in the container. The grip may be produced in a one-piece or two-piece construction. One useful embodiment includes a one-piece molded grip through which the wire handle is threaded prior to the handle being attached to the ears through the bail hole. In one embodiment, the plastic grip is molded as a two-piece construction. In this embodiment, a peg-and-hole configuration provides an engagement point for the two pieces of the grip.

As best seen in FIGS. 1 and 6, an applicator surface, also referred to herein as a shelf 20, is dimensioned to be received entirely within the base member. As such, a splash guard 24 is created by the upper portion of the base member that surrounds the shelf on three sides. The splash guard 24 that is created around the back and sides of the shelf 20 minimizes paint from running down the outside back and side walls of the base member. Moreover, the splash guard acts as a wall to stop the paint roller once the roller comes in contact with the splash guard to prevent the roller from rolling beyond the boundary of the base member.

Figure 26:
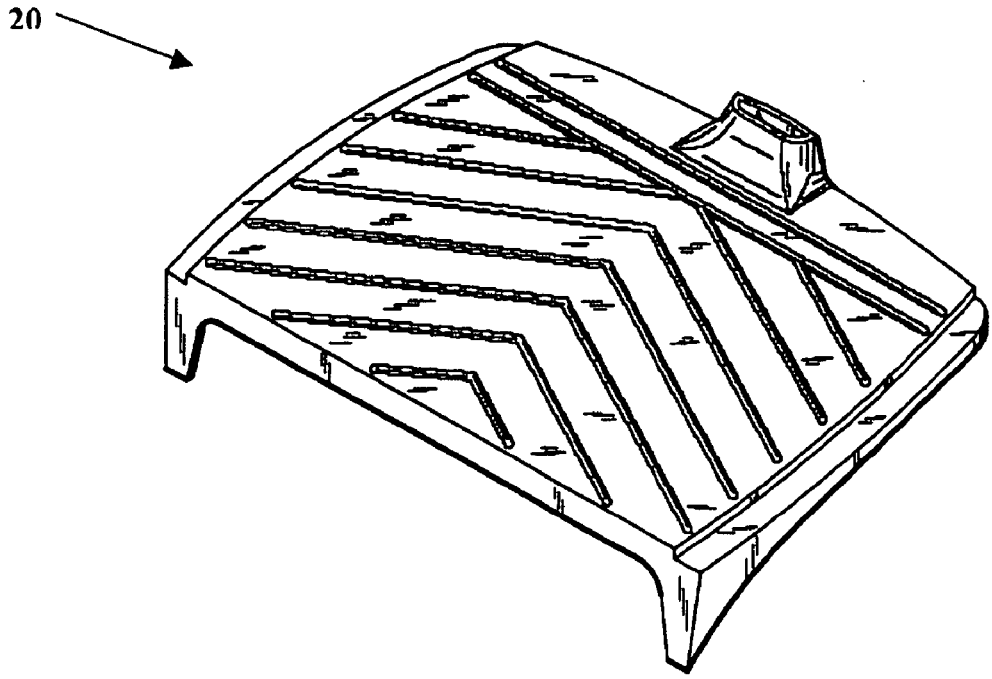
FIG. 26 is a perspective view of a shelf.
Figure 27:
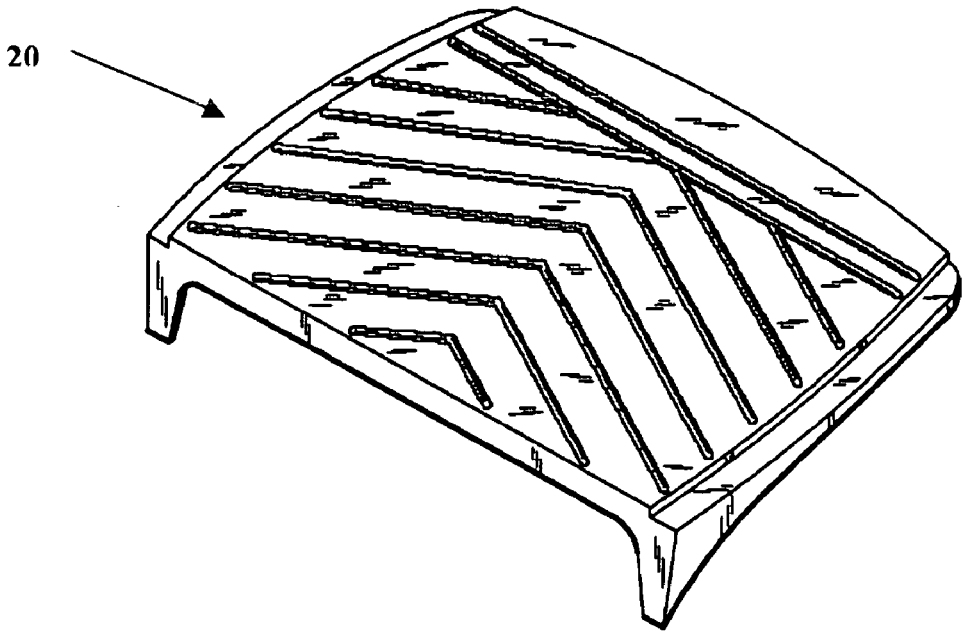
FIG. 27 is a perspective view of a shelf.

As shown in FIGS. 7, 8, 9, 10 and 11, the top surface, or face, one embodiment of the applicator surface 20 includes at least one hole 21, and more usefully a plurality of holes, which provide for drainage and removal of excess paint from the roller or other type of applicator, as well as providing for additive dispersion during agitation. The holes on the shelf may be particularly useful for the addition of colorant or other additive to paint or other fluid because the holes may provide for ample colorant or additive dispersion during agitation of the container. The holes of one useful embodiment measure about 0.50 inches in diameter. The viscosity of the material contained within the base member and rolled on the roller shelf, and considerations of proper drainage and prevention of skinning are all factors that may be considered when determining the number of and location of holes (see FIGS. 7 and 8). Alternatively, a shelf may be constructed with a continuous applicator surface. In this embodiment, no holes are provided in the shelf. FIGS. 26 and 27 illustrate alternative roller shelves that are provided without holes therethrough.

Figure 7:
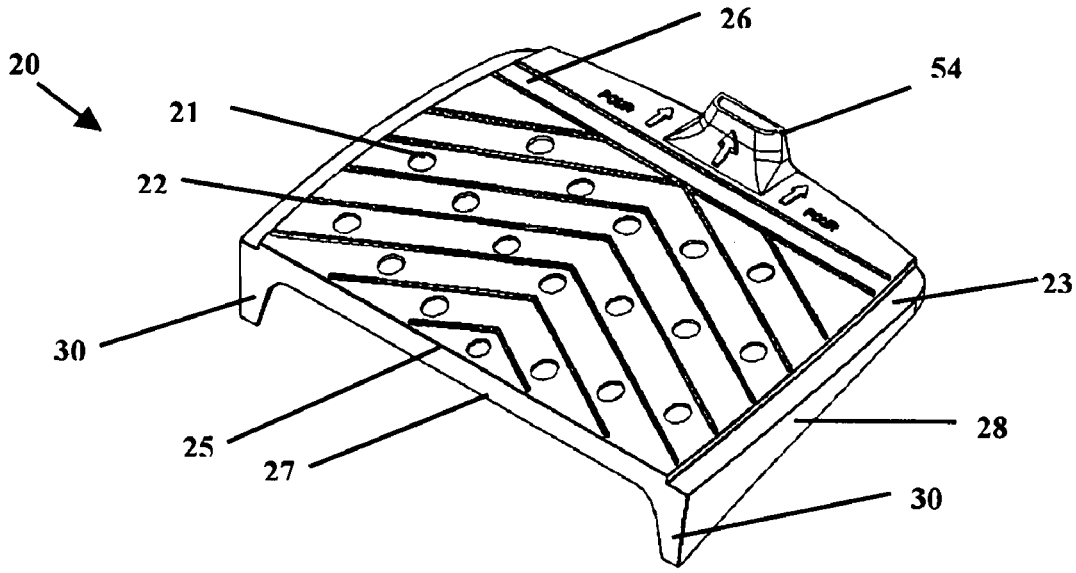
FIG. 7 is a perspective view of a shelf.

In one embodiment, the shelf may include raised ribs 22 that appear in an inverted "v" design, as viewed from the front of the container. The inverted "v" design guides excess paint from the center of the shelf toward a gutter 23, which is located along at least one side of the face of the shelf The raised ribs may be placed in a parallel configuration. It is to be appreciated that the raised ribs may be placed in any number of configurations, included but not limited to inverted "v" design ribs or latitudinally parallel ribs. If holes are provided in the roller shelf, the holes 21 may be placed between raised ribs 22. The ribs of one useful embodiment measure about 0.075 inches in height. In one embodiment, the shelf includes at least one gutter 23 on the face of the shelf. The shelf includes two opposing gutters along each side of the face of the shelf, adjacent to the side lips 28 of the shelf and parallel to the side walls of the base member, as depicted in FIG. 7. When the shelf is affixed into the base member, the gutters are adjacent to the side walls of the base member. The gutters prevent paint, or other viscous materials, from pooling in the area where the shelf meets the sidewalls of the base member by forming a channel for the free-flow of excess paint into the base member reservoir. The gutters allow for the drainage of excess paint from the roller shelf, even when holes are not provided in the roller shelf.

In one embodiment, the shelf may also include a back channel 26 that is positioned near the back edge of the face of the shelf. The back channel 26 functions to grip the fluid applicator, such as a roller or pad, during use as the applicator is pulled toward the front of the container.

In one embodiment, the shelf is about 11.75 inches wide as measured from side lip to side lip 28. The length of the shelf is about 7.55 inches as measured from front lip to back lip. However, the dimensions of the shelf may be varied, depending upon the size of the base member. For example, a wider base member may require a wider shelf.

In one embodiment, the shelf is wide enough to accommodate a standard size roller. It is to be appreciated, however, that the width of the shelf may be as wide as any base member will accommodate. In one embodiment, the width of the area on the shelf upon which the raised ribs 22 appear is generally not appreciably less than the width of a roller that may be used in combination with the container, such as a standard size roller, thereby ensuring that the entire width of a paint roller pad will come in contact with the raised ribs, however, raised ribs may be present on the roller shelf in any length, width or configuration.

The shelf of one embodiment is long enough to allow a standard roller to make at least one full revolution, thereby coating substantially the entire surface of roller pad with paint with as little as one rolling pass. In one useful embodiment, the shelf is also short enough to allow sufficient clearance between the front edge 25 of the shelf and the front wall 17 and lip 17*a* of the base member. Such clearance will ensure that there is an adequate access opening 31 for a user to insert a fluid applicator, such as a brush, pad or roller, into the fluid that is contained within the base member.

Figure 9:
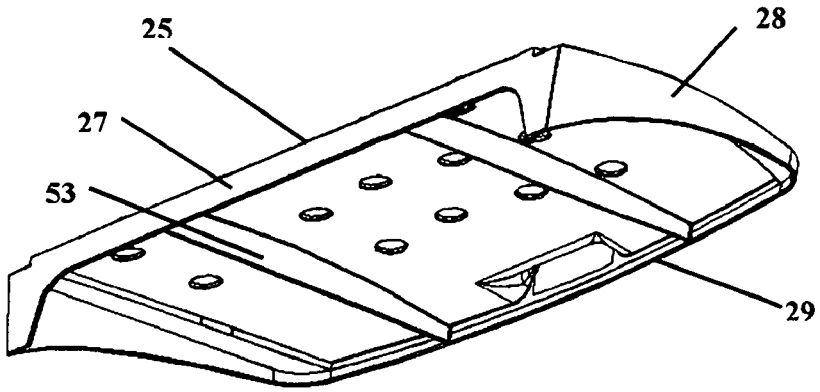
FIG. 9 is a perspective view of the bottom of a shelf.
Figure 10:
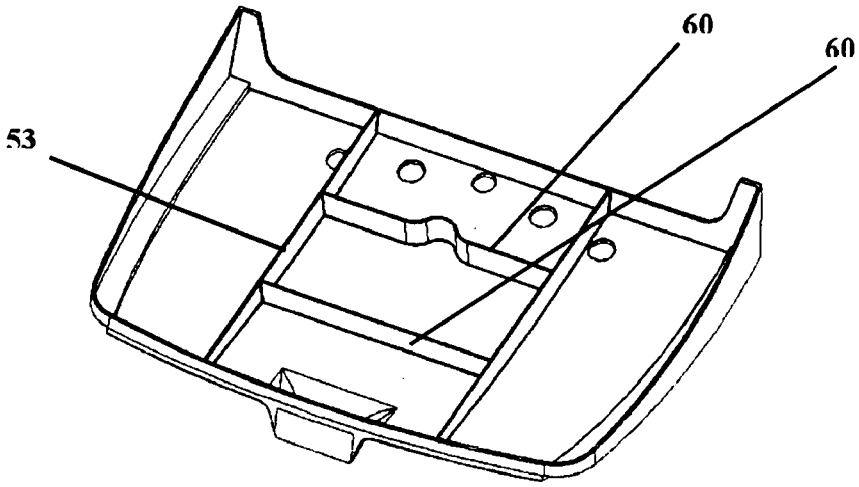
FIG. 10 is a perspective view of the bottom view of a shelf.

As shown in FIGS. 9 and 10, the bottom side of the shelf may include one or more ribs 53, 60 to reinforce the shelf and provide rigidity to the structure, thereby enabling the user to exert force on the shelf during use of a roller without the shelf concaving downward. The ribs may be placed parallel or perpendicular, or a combination of both, with respect to the side lip of the shelf.

Figure 8:
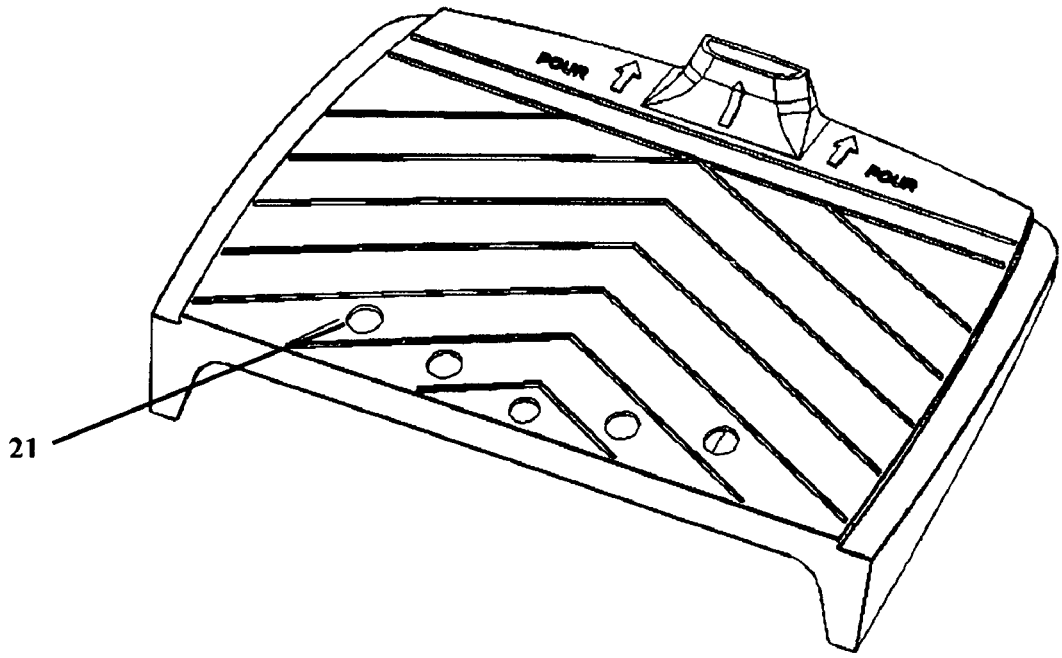
FIG. 8 is a perspective view of a shelf.

The shelf may be either permanently or removably affixed within the base member. The shelf may be placed onto the recessed area of the base member and is therefore suspended in the container generally above the fluid contained in the container. In one embodiment, the shelf is permanently affixed to the base member, such as by gluing, welding, or otherwise fastening, the shelf to the base member. In another useful embodiment, the shelf is removably affixed to the base member. As seen in FIGS. 7 and 8, the shelf may include a back lip 29 and two (2) side lips 28 that fit and lock into the shelf retention tabs 8. In this manner, the shelf remains in position during transportation, storage, and agitation of the container, and is ready to use when the consumer removes the lid of the container. Though the shelf retention tabs 8 may be positioned at any depth in the base member during manufacture, it is notable that the deeper the tabs are positioned in the base member, the less splashing and running of fluid, such as paint that may be applied with a roller, will appear along the outside of the back and side walls of the base member during use of a roller on the shelf. In one embodiment, a front lip 27 may also be included as a feature of the shelf because it adds rigidity to the structure of the shelf. The shelf retention tabs and engagement of the tabs with the lips of the shelf secure the shelf such that, though the shelf may be removed from the container, the shelf is not easily dislodged during agitation, use or transportation of the container. Furthermore, the notch 32 that could be placed on a retention tab, such as the front most retention tab, thereby accepting a foot 30 of the shelf also assists to prevent the shelf from moving or being dislodged during agitation, use or, transport of the base member It may also be useful if the shelf is, at least in part, above a level of the fluid contained within the base member. In one embodiment, the entire shelf and level of the liquid fill are dimensioned so that at rest on a level surface, the liquid level is below the lowest portion of the shelf.

Figure 28:
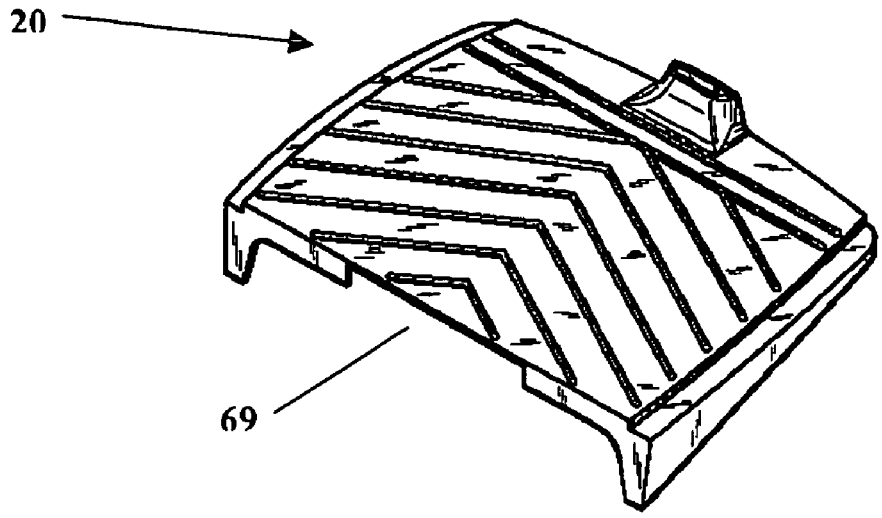
FIG. 28 is a perspective view of a shelf.
Figure 29:
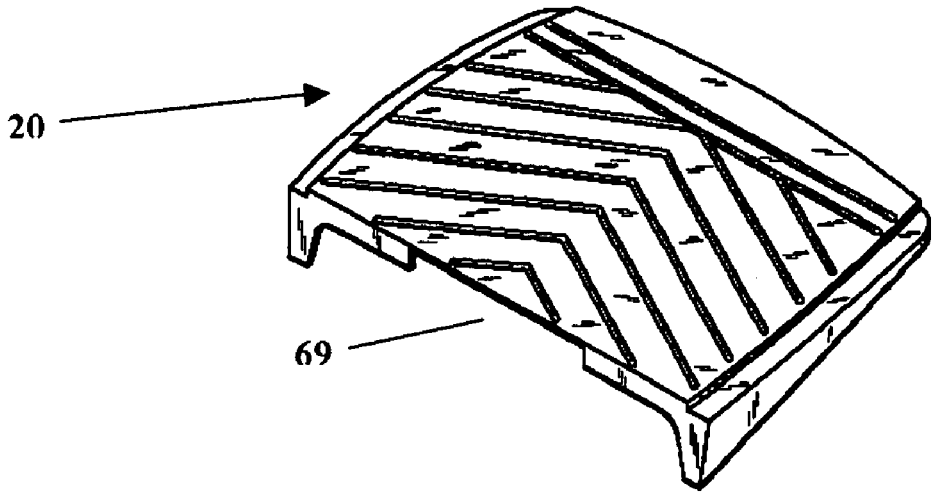
FIG. 29 is a perspective view of a shelf.

When the liquid contained in the base member is not at a level that is below the shelf, it is difficult to provide for additive to access the fluid contents that are just beneath the shelf. For example, when the shelf is constructed without any holes to allow for dispersion of an additive through the holes and into fluid contained beneath the roller shelf, and the fluid level is at or above the lowest point of the shelf, it is possible that any additive that is provided into the container will access only that fluid that is at or above the lowest point of the shelf, and that additive will not be able to reach any fluid that is beneath the shelf. This may be particularly true when, for example, the shelf is constructed with a front lip that would necessarily prevent additive from reaching fluid that is beneath the roller shelf. In order to remedy this potential issue, it may be desirable to provide for a shelf cutout 69 in the front lip of the shelf. One embodiment of a shelf cutout is depicted in FIG. 28. Another embodiment of a shelf cutout is depicted in FIG. 29. The cutout allows additive to access any fluid that may be present and not otherwise accessible due to the position of the front lip 27. One situation where a cutout may be particularly useful is when glycol or other non-skinning additive is provided to prevent or minimize the skinning of paint. When glycol is sprayed onto the roller shelf, some glycol is directed to the paint housed in the front of the base member by the gutters present in the roller shelf as well as by running down the shelf. Additionally, the inclusion of holes in a shelf would allow for glycol that is sprayed onto the shelf to access paint that is beneath the shelf. When a shelf is constructed without the inclusion of holes, a cutout in the lip of the shelf would allow glycol to access all paint contained within the base member.

Figure 11:
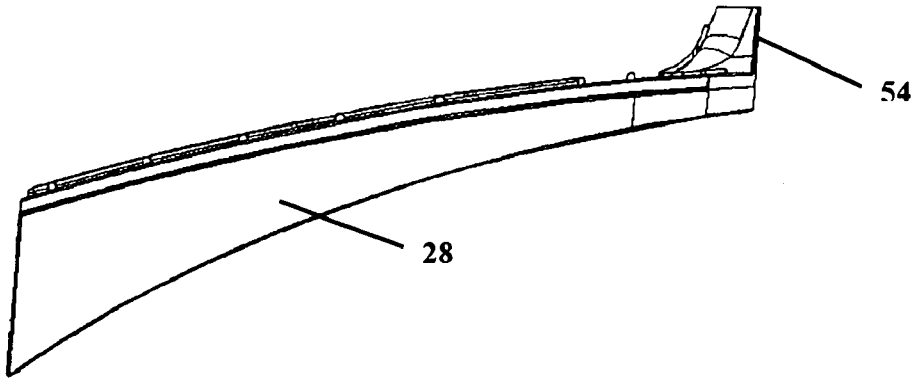
FIG. 11 is a side view of a shelf

As best depicted in FIG. 11, in one embodiment, the shelf 20 bows slightly upward, forming a longitudinal arc. In an alternative embodiment, the shelf may be flat. Furthermore, a flat shelf may be placed in the base member horizontally, or at an angle greater than 90° within the base member. It is sometimes desirable, however, that the shelf bows upward to form an arc, thereby increasing the surface area of the shelf without greatly decreasing the clearance area for insertion of an applicator for applying the composition contained in the base member. Accordingly, a bowed shelf can have a relatively shorter length relative to the overall length of the container, but continue to accommodate a full revolution of the roller pad. Moreover, an additional feature of a shelf that bows slightly upward is that it provides for better usability and manipulation of the roller by a user because it is contoured to accept the force exerted through use or a roller.

As best seen in FIGS. 7 and 8, in one embodiment, the shelf may include an integrated pour spout 54. The pour spout can be located proximal to the back lip 29 or a side lip 28 of the shelf. The pour spout is an upward projection that guides fluid out of the base member so that the user may transfer the contents of the container into another container, if desired. In one embodiment, the pour spout is a generally rectangular projection with rounded corners and a generally rectangular opening; however, the spout may alternatively be any shape that will provide for easy pourability of a fluid, such as an annular opening or triangular opening. The pour spout may be a self-enclosed structure that forms an opening. Alternatively, the pour spout may be comprised of adjacent side walls that are positioned such that the side walls or back wall of the base member are used to create an enclosed structure through which fluid may be poured. In an alternative embodiment, the pour spout is an upward projection that is semicircular and not self-enclosed, but rather, forms an enclosed structure through abutment with any wall of the base member. Markings on the face of the shelf may be provided as a reference to assist the user in pouring fluid out of the base member.

In one embodiment, the pour spout includes four (4) adjacent side walls that form an enclosed structure through which fluid is transferred. In this embodiment, the pour spout height is about 1.07 inches as measured from the bottom edge of the back lip to the top edge of spout. The width of the spout is about 1.65 inches When the job has been completed, the base member may be resealed with the lid without removing the shelf. Because each container is sold with a shelf, it is unnecessary for a consumer to purchase, tray, such as a paint tray. Moreover, because the shelf is housed completely within the base member it is unnecessary for the consumer to remove the shelf for separate storage.

From the foregoing it will be appreciated that the base member acts as a reservoir from which fluid can be applied to an applicator, such as for example a brush, pad or roller, and into which surplus fluid drains from or through the shelf.

Figure 12:
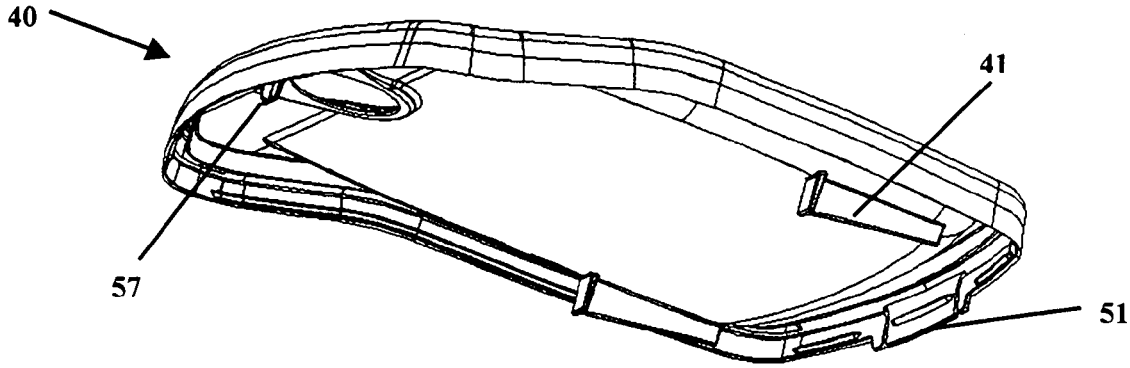
FIG. 12 is a perspective view of the underside of a lid.

A lid is provided with the container to cover the base member before, between, and after usage. To achieve a tight seal, the perimeter of the underside of the lid is fitted with a gasket. As best seen in FIG. 12, during transportation or shaking of the container and at such other times when the lid of the container is engaged on the base member, the roller shelf may be additionally held in place by one or more hold-down lugs 41 that are located on the underside of the lid 40. When the lid is engaged with the base member, the hold-down lugs 41 rest upon or near the face of the shelf, thereby maintaining the shelf on the shelf retention tabs 8. In one embodiment, the hold-down lugs would not rest on the gutter of the shelf so that any fluid that may accumulate in the gutter could flow through the gutter into the open area within the base member without being impeded by a hold-down lug.

Figure 13:
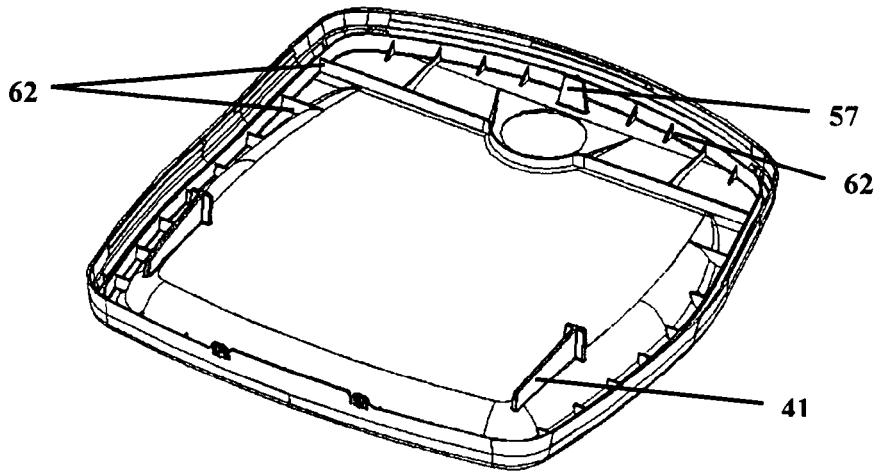
FIG. 13 is a perspective view of the underside of a lid.
Figure 14:
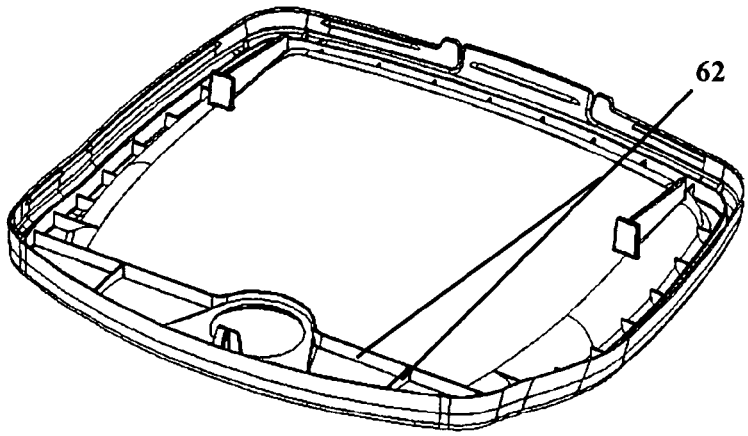
FIG. 14 is a perspective view of the underside of a lid.

In one embodiment, the underside of the lid, as shown in FIGS. 13, and 14, may include a series of reinforcing, or stiffening, ribs 62 that are generally located near or around the periphery of the lid underside. The stiffening ribs provide the lid with greater rigidity. It should be appreciated that stiffening ribs can be placed at any location on the underside of topside of the lid.

The lid can include a tear-off strip 42 (see FIG. 3), which must be removed by the user in order to detach the lid from the base member. Until such time as the tear-off strip is removed by the end user, the lid cannot easily be disengaged from the base member. In one embodiment, the tear-off strip contains one removal point, located on the backside of one of the sidewalls of the lid. In one embodiment, the tear-off strip includes and may be removed through two removal points 55. The area between the two tear-off strip removal points serves as a lid tab 51. One tear-off strip that may be used in accordance with the present invention is described in U.S. Pat. No. 6,543,635 and U.S. Patent Application Pub. No. 2003/0160051, which are incorporated herein in their entirety by reference thereto, however, it will be appreciated that any mechanism by which the lid can be secured to prevent it from being removed during transportation, storage, or shaking, and also allows the lid to be replaced onto the base member between uses, may be utilized in accordance with the container.

Adjacent to the tear-off strip is a lid tab 51 that the user pulls upward to disengage the lid after the tear strip has been removed (See FIGS. 3 and 3*a*). The lid lifting groove 56 is proximal to the lid tab so that the user has sufficient clearance between the lid tab and base member to insert several fingers to assist in removing the lid.

Generally, there are two levels of parallel protruding rims on the inner perimeter of the lid side wall 47; each level of rims appears on substantially the entire periphery of the underside of the lid (see FIGS. 6*a* and 6*b*). However, in alternative embodiments, spaces can be included that interrupt the continuity of protruding rims around the inner perimeter, particularly on the lower protruding rim 43, in order to easily enable detachment of the lid from the protruding rims. In one embodiment, the protruding rims do not round the corners of the inner periphery of the lid; however, it is to be appreciated that the protruding rims may extend the entire length of the inner periphery in an alternative embodiment.

The lower level protruding rim 43 of the lid "locks" onto the middle ring 11 of the outside top edge of the base member, and the upper protruding rim 44 "locks" onto the upper ring 10 of the outside top edge of the base member when the lid is engaged onto the base member. This locking mechanism is best illustrated in FIGS. 6*a* and 6*b*. The locking is achieved when the lid is forced downward onto the base member. Through a downward force, the protruding rims are displaced to beneath the rings of the base member and remain fitted beneath the rings until the user removes the tear-off strip and lifts upward on the lid tab 51.

When the tear-off strip of the lid is removed, the lower protruding rim 43 is removed along with it. Despite the removal of the tear-off strip by the consumer, the upper protruding rim will continue to operate to lock under the upper ring to hold the lid in place on the base member if and when the user wishes to replace the lid onto the base member during the course of or at the conclusion of a work project.

In one embodiment the upper surface of the lid includes a raised flange that is located along a portion of periphery of the topside of the lid. As shown in FIG. 1, in another embodiment, the upper surface of the lid includes a back flange 45 and opposing side flanges 46. The flanges provide for a containment area for another container to be stacked therein, while preventing stacked containers from sliding off of one another in the back or side direction. In this way, multiple containers may be stacked during transportation or storage. In one embodiment, there is no flange on the front of the top side of the lid. Alternatively, a front flange may be included to ensure that multiple stacked containers are completely nested upon one another and cannot easily slide off of one another. However, not including a front flange provides the advantage of easily sliding containers off of one another in the front direction, for example, when multiple containers are stacked such as on shelves or in a store display. Flanges are merely one illustrative way to provide for the nesting of lidded containers. Other means for achieving nesting of containers (when sealed) when stacked upon one another may be employed as well.

In one embodiment, the upper surface of the lid is a generally flat surface, with a slight downward slope toward the front of the lid, generally where an additive hole could be housed. Generally, however, the lid is contoured to complement the shape of the top edge of the base member.

Advantages of a downward sloping lid design include those advantages that are attained from a downward sloping top surface of the base member, namely, the slope provides for easier removal of multiple stacked containers by making it easier to slide containers off of one another; the slope allows for a space between the lid of one container and the bottom of the container that is stacked upon it, which thereby allows to the finger grip on the underside of the base member; and the slope results in a reduction in headspace.

Due to the downward slope on the topside of the lid, it may be advantageous for the underside of the lid to have a stacking lug 57, as seen in FIG. 12. A stacking lug is particularly advantageous when, for example, multiple lids are stacked upside down, such as during manufacturing, or during transportation or storage of the lids before the final container is assembled. The stacking lug operates to level multiple stacked lids to prevent the stack of multiple lids from leaning and falling over due to the slope of the lid. The stacking lug is located on the underside of the lid, proximal to the area of the lid that is sloped.

In one embodiment, the container may include an additive hole 50 (see FIG. 1) that is located in the lid for the addition of a variety of desired additives, including but not limited to additives such as colorants, catalysts, biocides, or other materials, to the composition contained in the base member without removal of the lid. In one useful embodiment, the additive hole is resealable and includes a plug or other type of closure affixed therein (see FIG. 15). A plug is particularly advantageous because the container, when it is available for purchase, includes, a composition, a shelf, and a lid that is securely and tightly sealed. The presence of a plug allows addition of additive without removal of the securely fastened lid, and also allows resealing of the additive hole. A plug that may be used in accordance with this invention is disclosed in U.S. Pat. No. 5,660,302, which is hereby incorporated in its entirety by reference thereto. Generally, the additive hole is placed proximal to the front of the lid and centered with respect to the side flanges of the lid, although other locations are also practiced. In one embodiment, the center point of the additive hole is about two (2) inches from the front edge of the lid. It is to be appreciated that the additive hole may be placed anywhere on the lid. It may be advantageous to place the additive hole so as to conveniently correspond to the placement of dispensing nozzles of most colorant dispersion systems. Through use of an additive hole, it is unnecessary for a store clerk to remove the lid to introduce the colorant to paint, or any additive to the composition housed in the base member, and therefore, the lid remains securely and tightly fitted on the base member until such time as the consumer removes the tear-off strip and disengages the lid. Therefore, accidental removal or dislodging of the lid during transportation by the consumer from the store to the job site is minimized.

Several types of paint mixers and shakers may be used in accordance with this invention. One such shaker or mixing apparatus that may be used in accordance with the present invention is the 5990 multi-size platform shaker that is manufactured and sold by Red Devil Equipment Company. Other shakers that may be used include the Harbil® 5G HD Case Mixer manufactured by Fluid Management, Inc., the Mega-Mix 40/20 shaker sold by Highland Laboratories Inc., and case mixers manufactured by National Paint Equipment.

Figure 25:
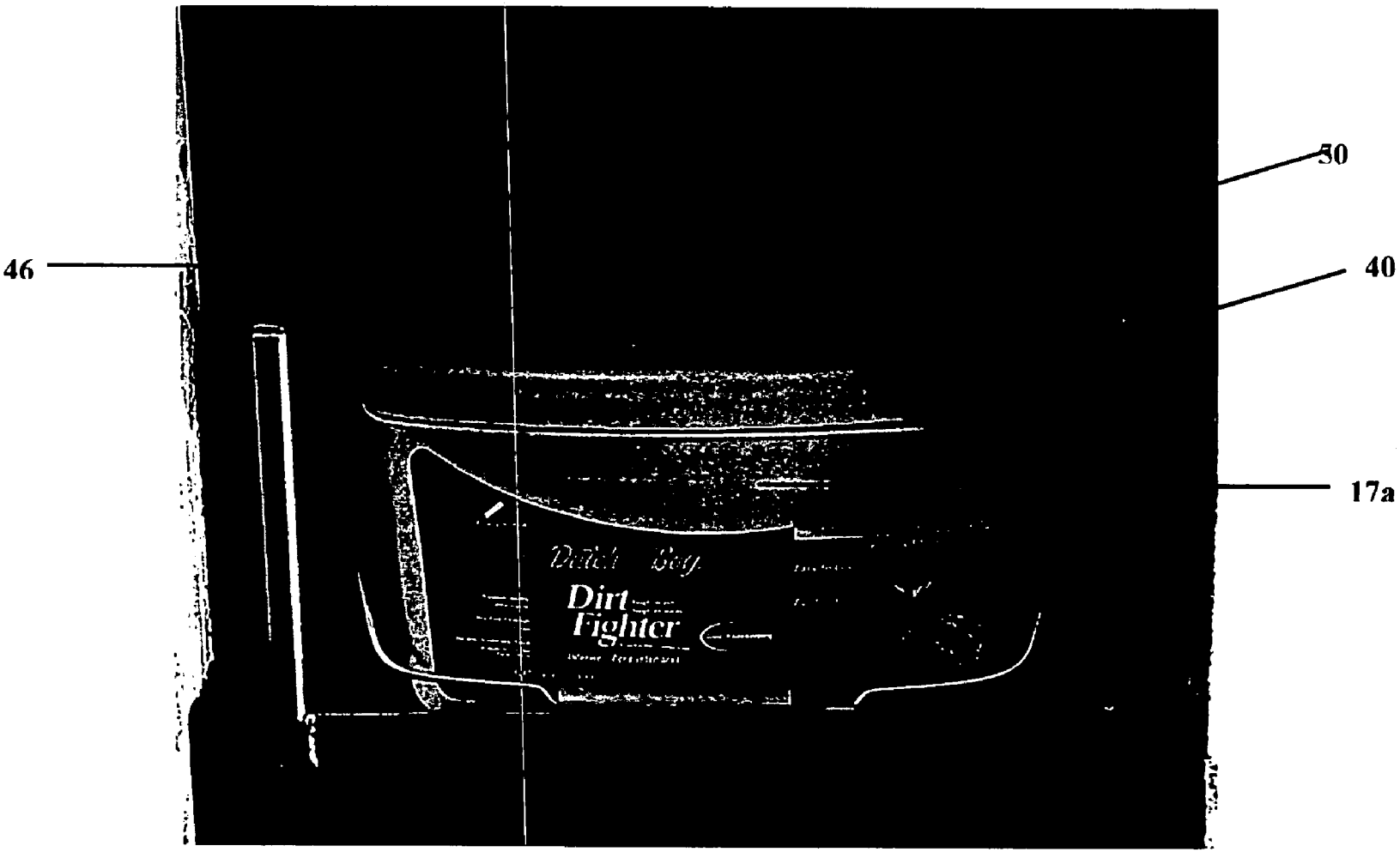
FIG. 25 is a front view of the container housed in a shaker.

When shaking the container within certain mixers and shakers, it is advantageous to provide sufficient agitation to promote good pigment or additive dispersion. However, sufficient agitation may be more difficult to achieve with certain shakers due to the manner in which the container is agitated within the shaker. For example, when agitating the container in the Harbil® 5G HD Case Mixer, the container is generally held in place during mixing by a pressure plate that applies downward force on the lid of the container, thereby retaining the container in a fixed position during shaking. However, unlike some containers that have a relatively flat lid and top surface upon which the pressure plate can exert even pressure and force, the shape and contour of the lid and receiving base member of certain containers may prevent exertion of even force throughout the surface area of the lid. Thus, it is desirable to provide an insert or adapter for use with the container so that the pressure plate of a mixer can exert even pressure and force on the substantially the entire surface of the lid despite the unique shape of the lid. For example, the unique shape of one embodiment of the subject container and lid provide for a downward slope at some point on the lid and base member, such as for example, a downward slope toward the front of the lid and base member. The downward slope may not allow for the pressure plate of the case mixer to come in even contact with the lid surface such that sufficient pressure and force and applied throughout the surface area of the lid, therefore allowing an area of the lid that is not subject to downward force, and which is thereby susceptible to delatching during agitation (see FIG. 25). Consequently, during longer periods of agitation, it is possible that the liquid contents in the container may escape through the area where the lid is not forced downward. Furthermore, even in alternative embodiments that provide for a flat lid, it may be desirable to use an insert so that the insert, and not the lid, bears the force from the pressure plate of the shaker. As such, concerns that the appearance or integrity of the lid surface may be compromised during agitation are alleviated.

Figure 24:
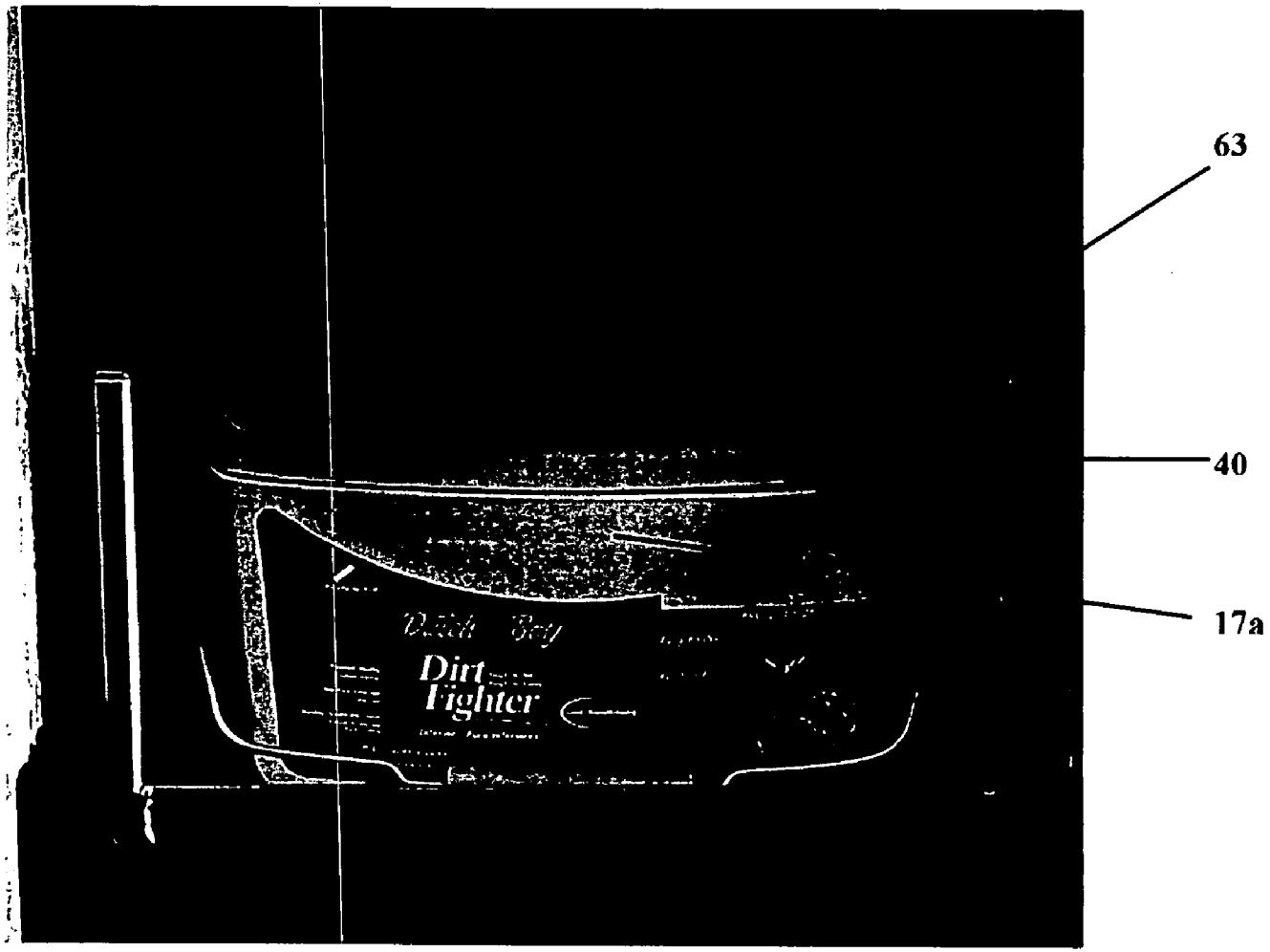
FIG. 24 is a front view of the container housed in a shaker, with the insert placed on the lid of the container.

In order to alleviate this potential concern, it is desirable to provide for an insert 63 or adapter to be placed on the top of the lid and for the insert to be molded to fit the shape and contour of the lid on one side of the insert, while maintaining a flat surface on the opposite side of the insert, for example, the side that comes into contact with the pressure plate of the case mixer, so that it can receive even pressure and force from the pressure plate of the mixer (see FIG. 24).

The insert is molded from any conventional thermoplastic material, such as polycarbonate, polypropylene, or polyethylene copolymers. In one useful embodiment, the insert is constructed from polyethylene.

Figure 16:
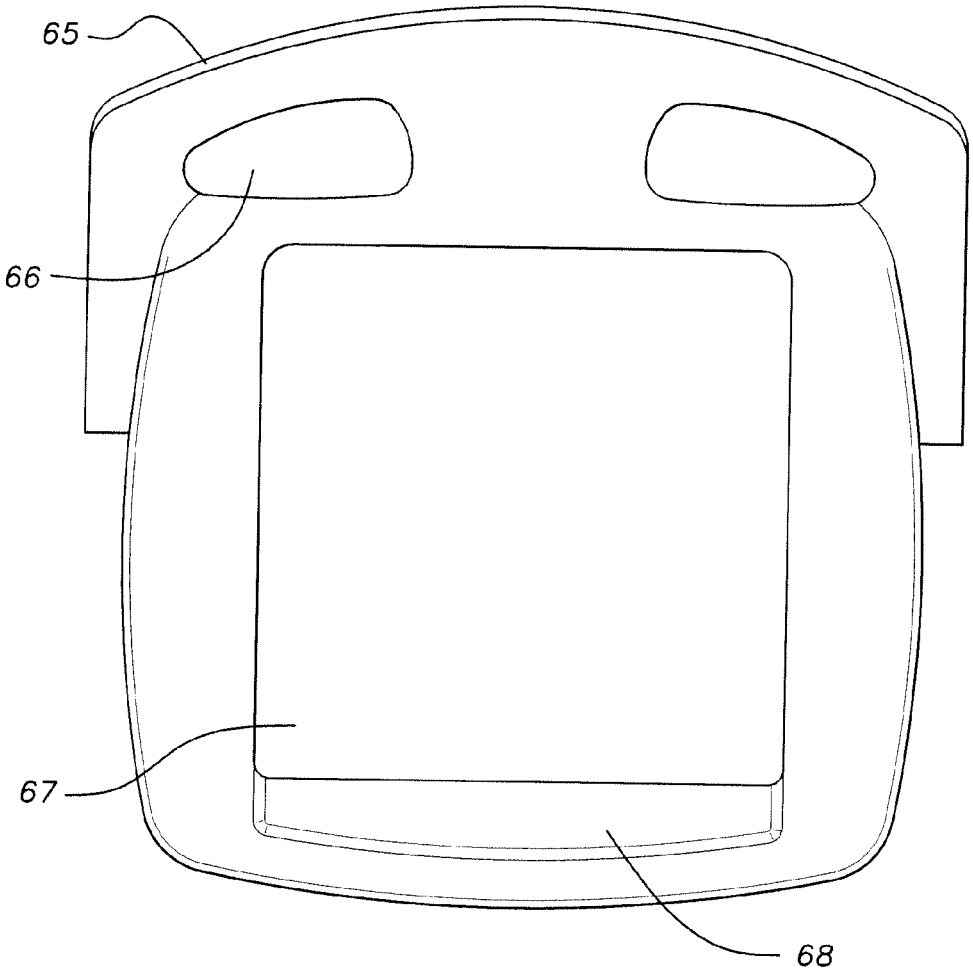
FIG. 16 is a bottom view of the insert.
Figure 17:
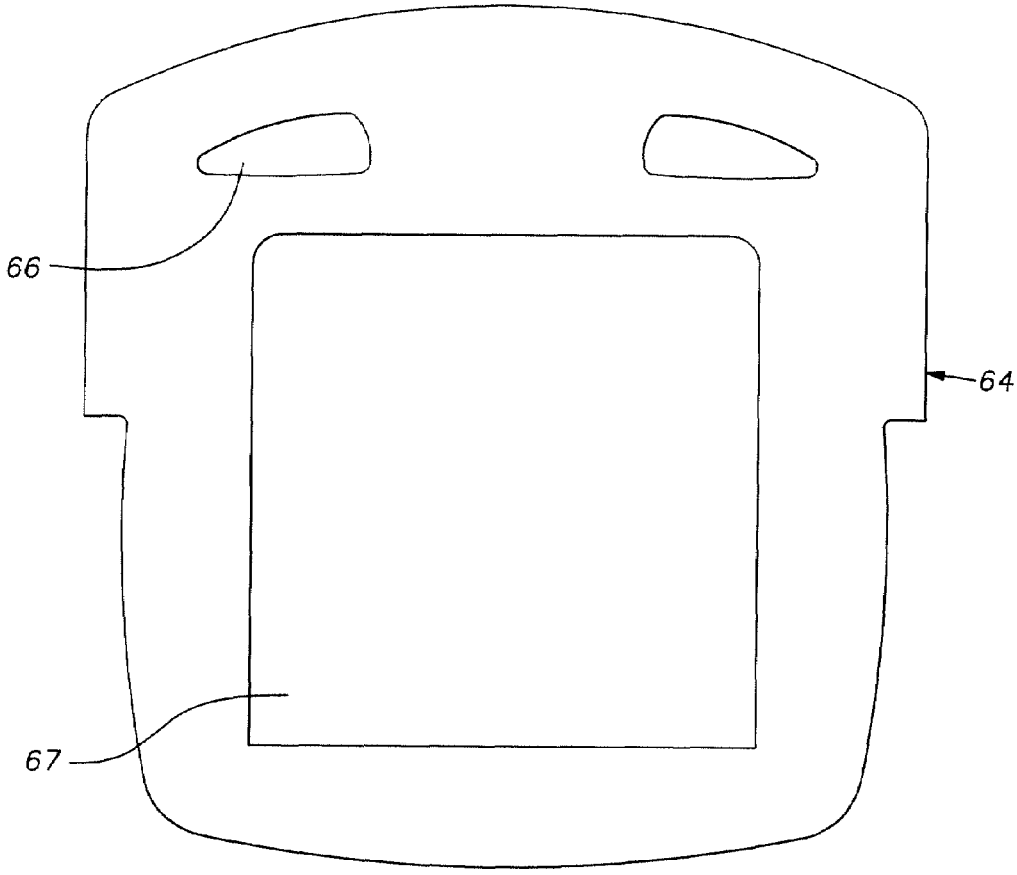
FIG. 17 is a top view of the insert.
Figure 18:
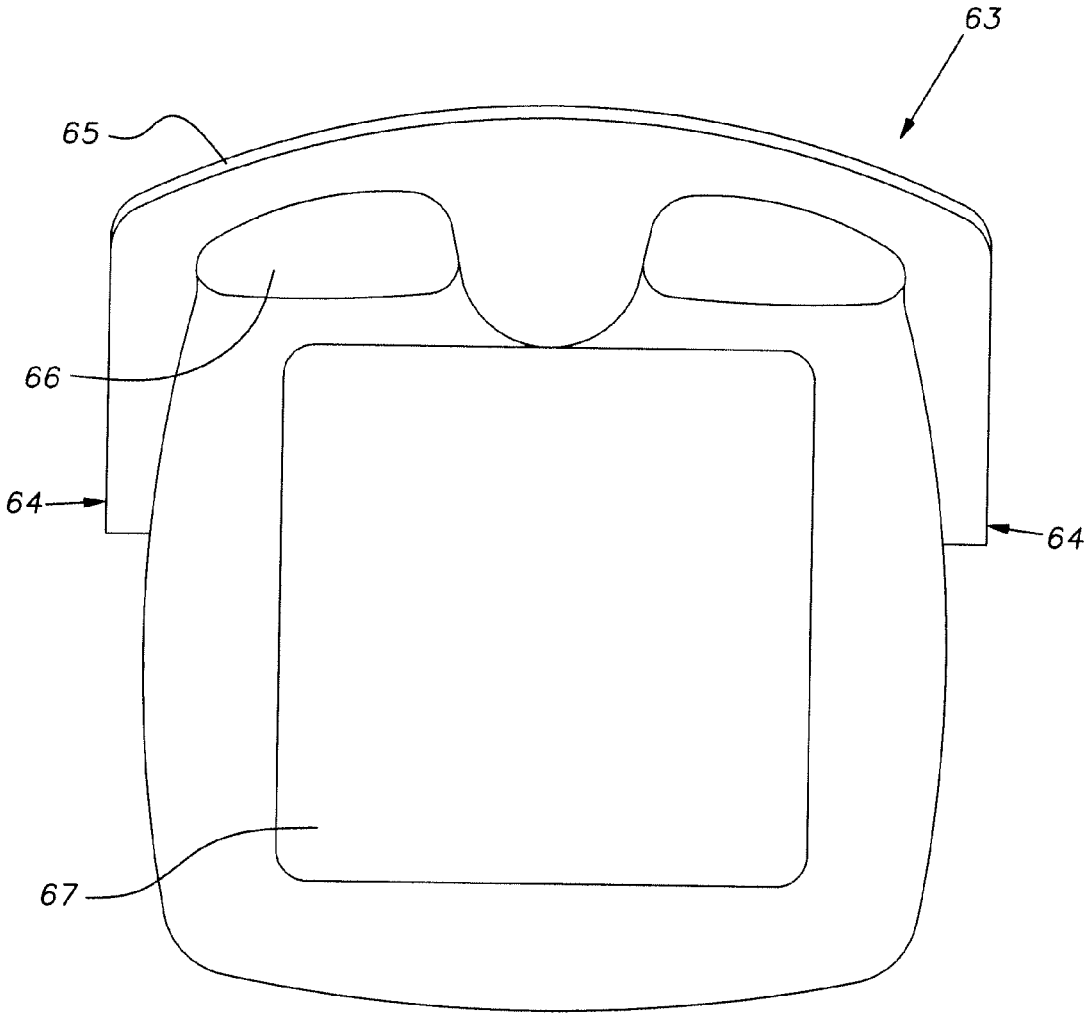
FIG. 18 is a bottom view of the insert.
Figure 19A:
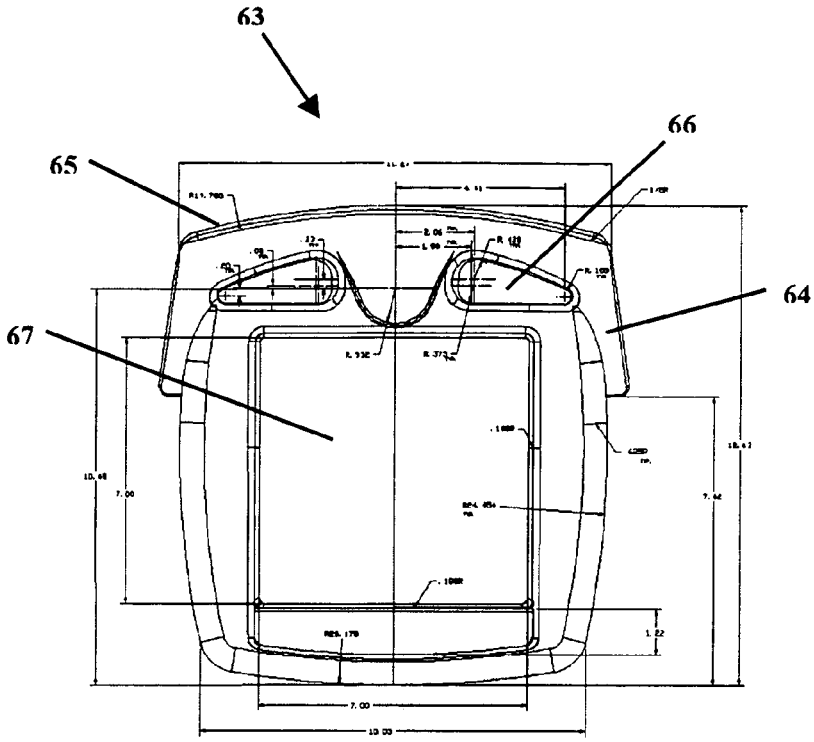
FIG. 19*a* is a bottom view of the insert.
Figure 19B:
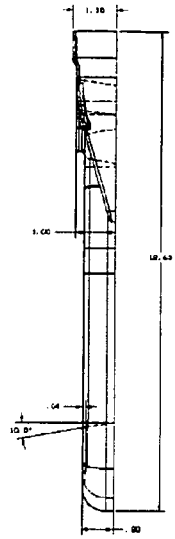
FIG. 19*b* is a front view of the insert.
Figure 19C:
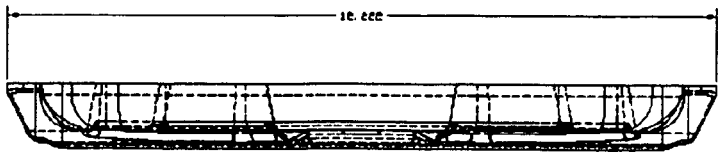
FIG. 19*c* is a side view of the insert.
Figure 20:
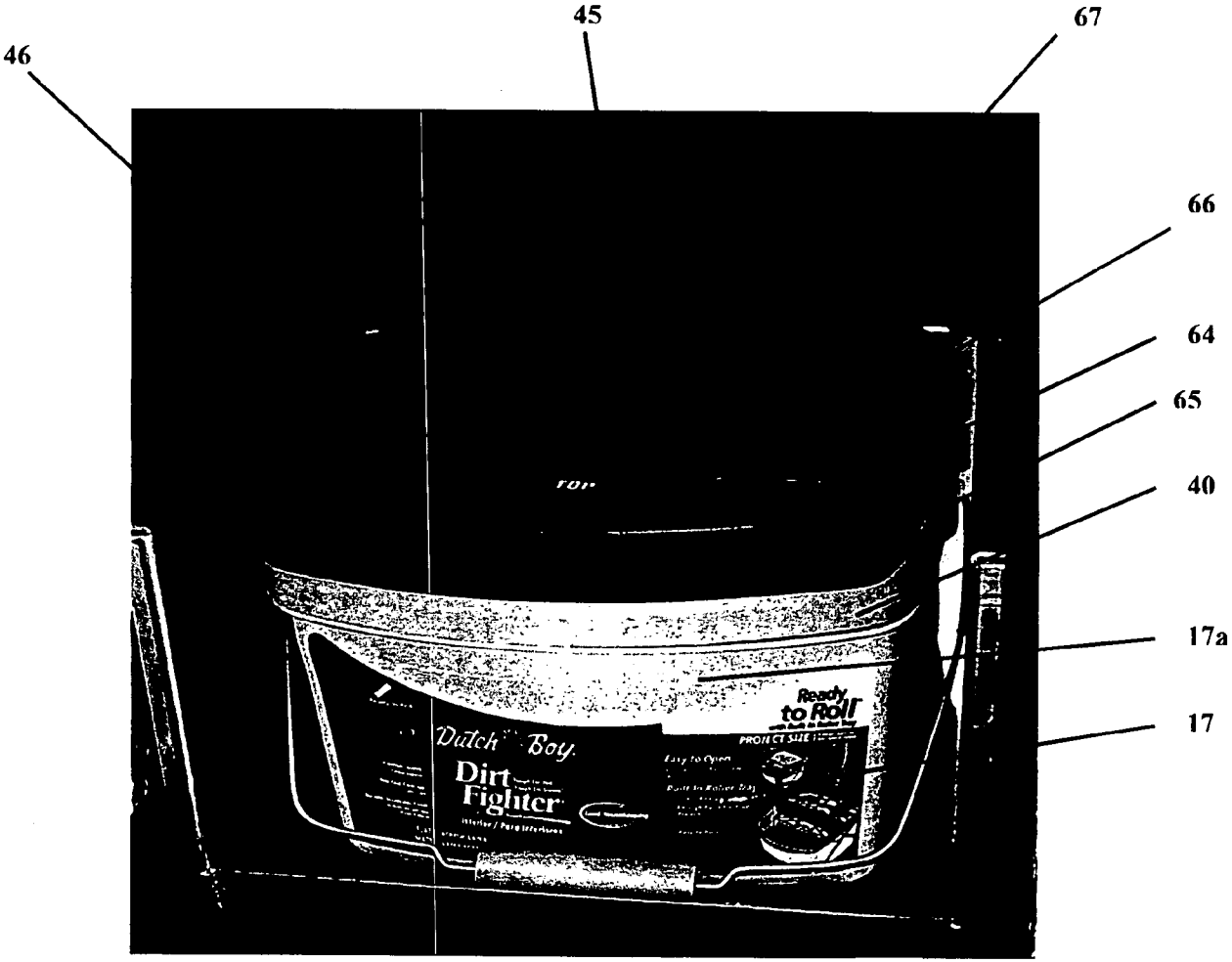
FIG. 20 is a front view of the container housed in a shaker, with the insert placed on the lid of the container.
Figure 21:
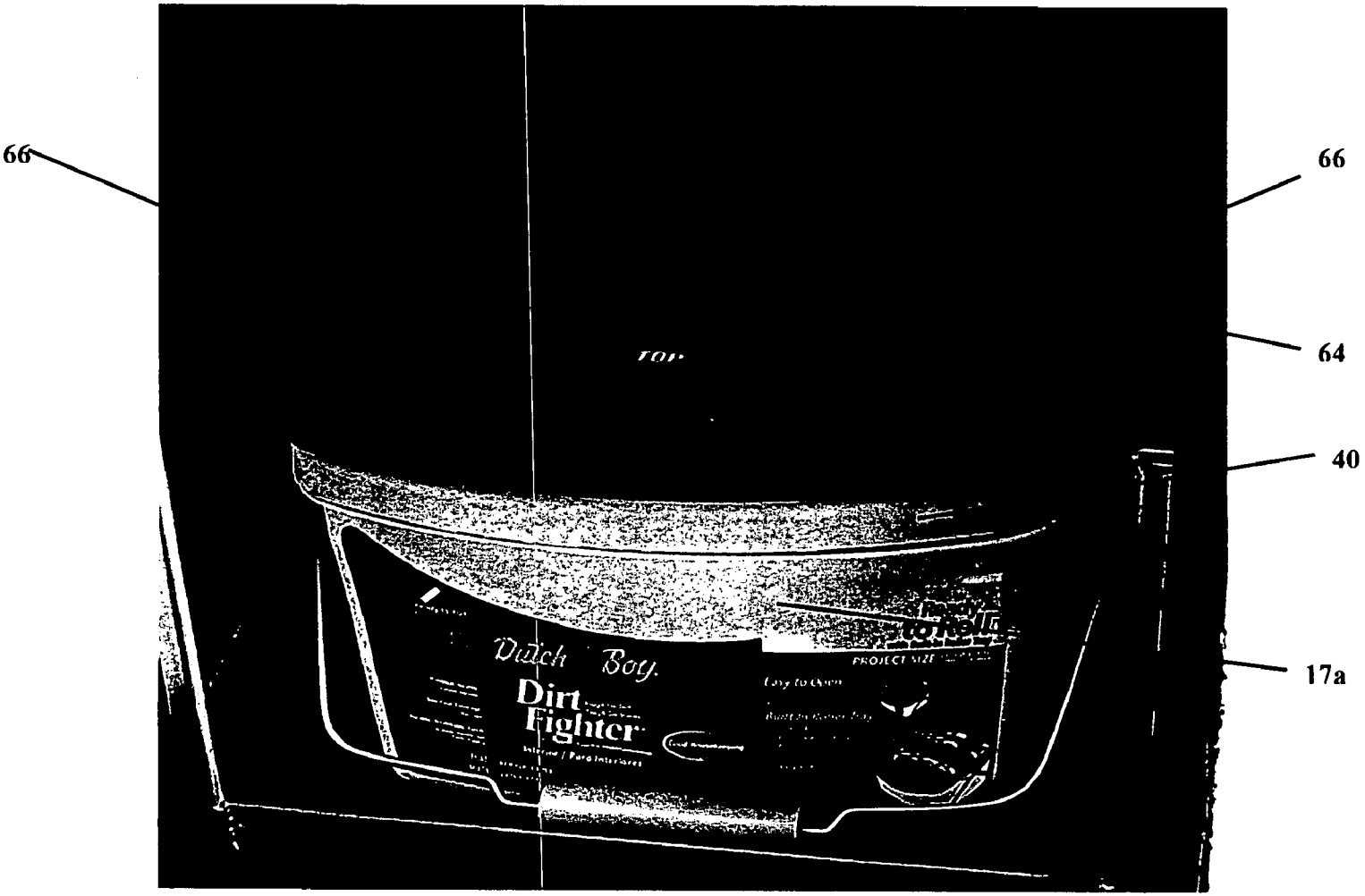
FIG. 21 is a front view of the container housed in a shaker, with the insert placed on the lid of the container.
Figure 22:
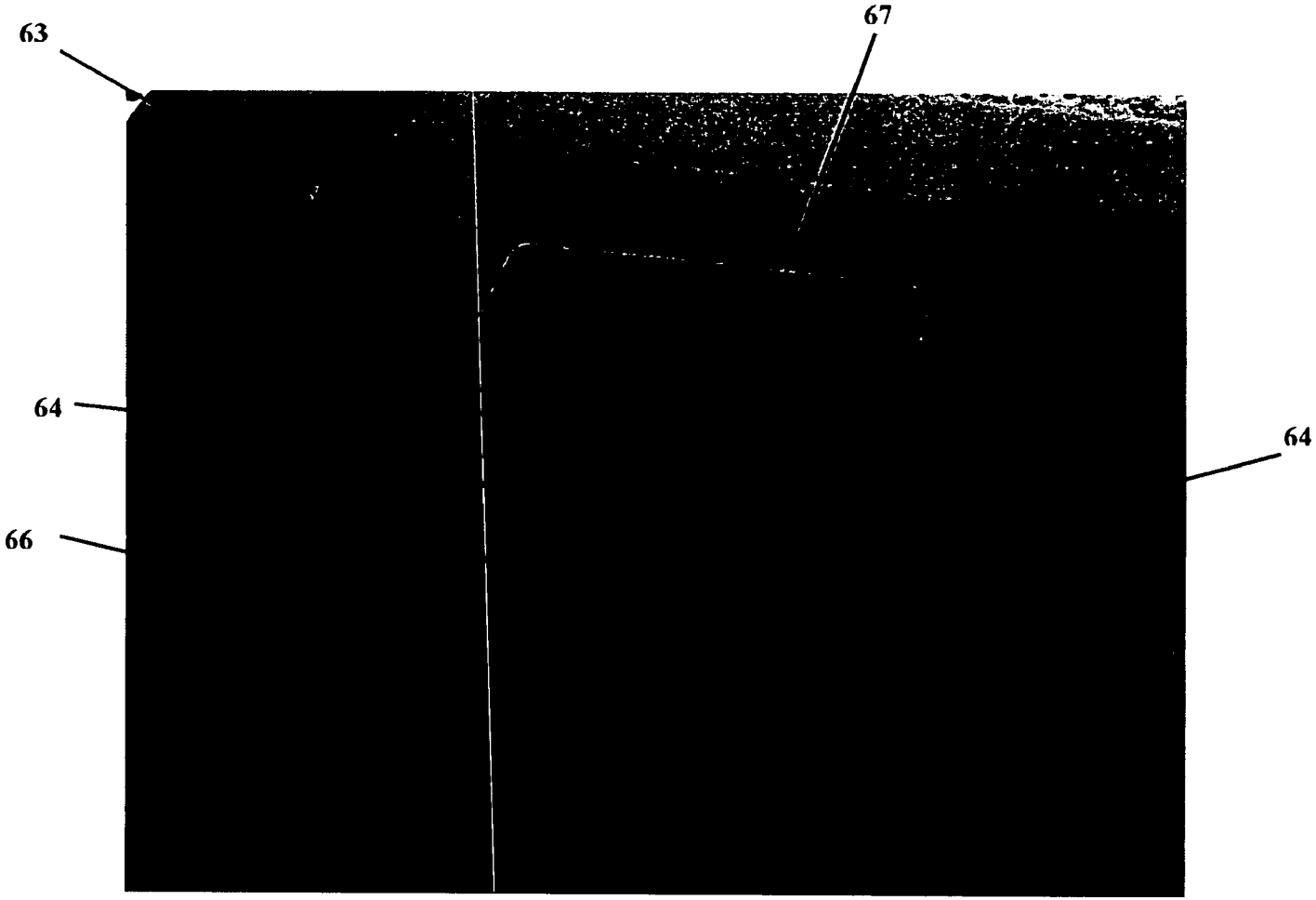
FIG. 22 is a perspective view of the top of the insert.
Figure 23:
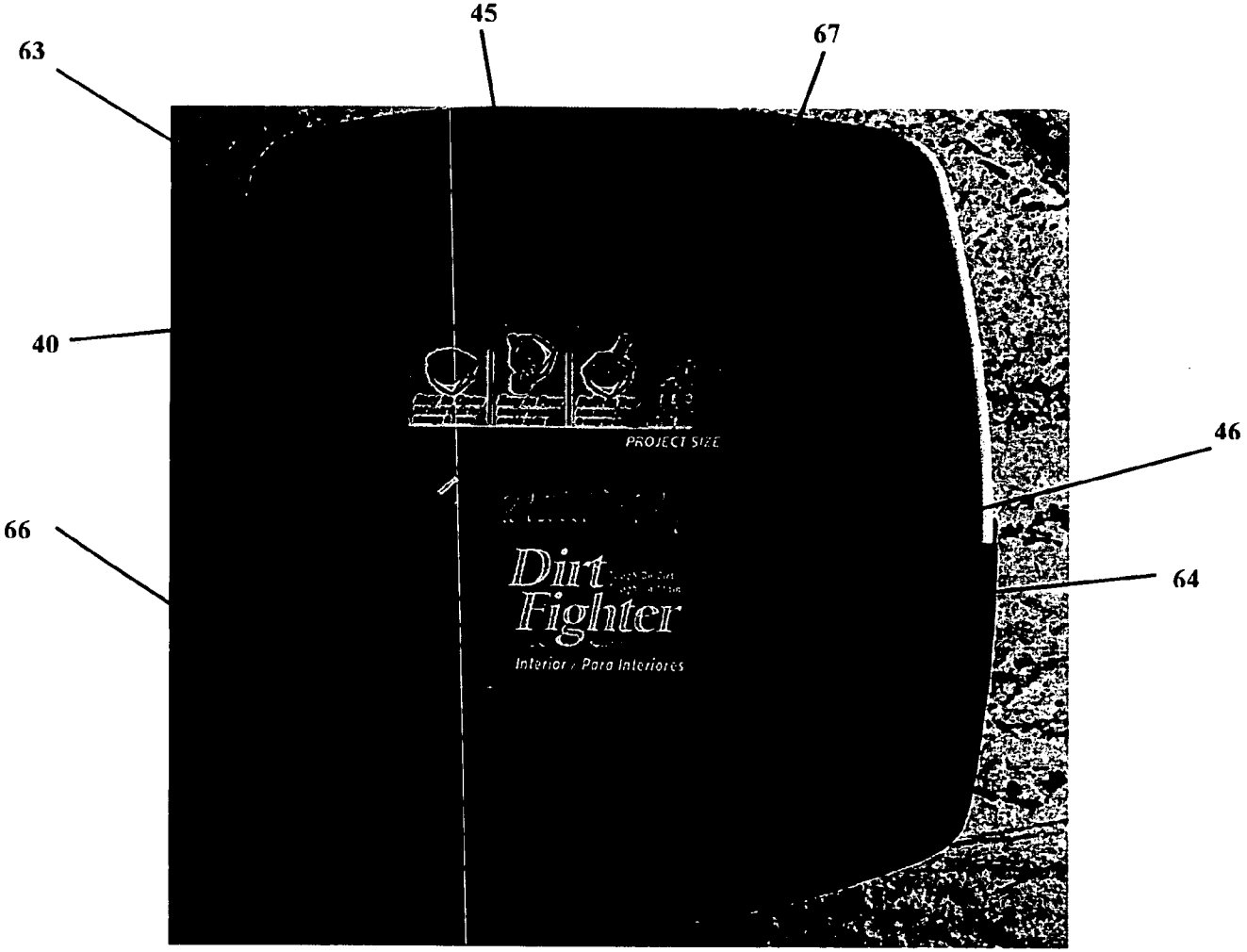
FIG. 23 is a top view of the insert that is placed on container lid.

In one embodiment, the insert includes two opposing faces. The first face (as shown in FIGS. 16 and 18) is contoured to mirror the shape of the topside of the container lid. The opposite face of the insert is constructed so that it can accept even pressure from the pressure plate of a shaker. In one embodiment, even pressure is achieved by providing a generally flat opposite face (as shown in FIGS. 17, 20, 21, 22, and 23). The insert may also include two opposing side surfaces, a back surface and a front surface. The insert is at least partially nested within the lid of the container. As previously stated, the upper surface of one embodiment of the lid includes a back flange 45 and opposing side flanges 46. The flanges provide for a containment area for another container to be stacked therein, and likewise, during shaking of the container within a mixer, the containment area can accept an insert.

In one embodiment, the insert can also be provided with one or more wings 64. The wings are a lateral extension of the insert. If the lid in connection with which the insert is used is a downward sloping lid, it may be useful to employ wings that project over the downward-sloping peripheral edges of the lid so that application of the pressure plate will maintain even force and pressure on substantially the entire surface area of the lid (see FIGS. 19 20, 22, and 23).

In one embodiment, the insert is placed into the containment area that is surrounded by the flanges on the container lid. The back and side flanges on the lid act as a guide to insure that the insert is nested within the containment area and to prevent the insert from being placed incorrectly. When it is nested, the insert is at least flush with the flanges appearing on the lid. In another embodiment, the insert is slightly higher (or taller) than the tallest flange or other highest (tallest) point of the container lid, so that the pressure plate on the shaker will make contact with the insert itself and not with the container lid or flanges (see FIGS. 20 and 21). In one embodiment, it may be useful in include a lip 65 on the area of the insert that corresponds to the front of the container. The lip would catch onto the front of the container or lid and thereby act as a stop in such instances as when the insert is slid onto the top of the lid, such as when there is no front flange on the lid.

It may also be useful to include at least one finger hole 66 in the insert so that it can easily be accessed for insertion or removal from the containment area. Moreover, if it is desired that a label or other type of marking appear on the lid surface, it may be useful to provide a cut-out 67, or vacant space, in the insert so that the portion of the insert that overlaps with such marking will not come into contact with the label or marking and does not comprise the quality or integrity of the marking, such as may occur during periods of agitation due to the friction resulting from the insert on the lid surface (see FIG. 23). Minimizing friction between the insert and label or other marking can also be achieved by creating a recess 68 in the area of the insert that would ordinarily be in contact with the marking (see FIG. 16). In this way, particular portions of the insert can be designed so as not to be in direct contact with the lid surface.

The characteristics of the insert may be varied according to the actual dimensions of the lid. In any event, it is useful to provide an insert that comes into contact with a pressure plate of a mixer, either in addition to or in lieu of the lid making contact with the pressure plate, and can be removed after agitation of the container.

The container disclosed herein may be modified to include additional features. It may be desirable, for example to attach a power roller or sprayer to the container through the hole in the lid that otherwise houses an additive hole. Such modifications may also include the adaptation of a valve or other lid design that would allow for direct connection of spray equipment to the container.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A container comprising:

a base member, a shelf that is housed within the base member, and a lid, wherein said base member comprises an interior well defined by a back wall, a first sidewall, a second sidewall, a front wall and a floor, wherein the floor comprises a first side edge that is adjacent to said first side wall; second side edge that is adjacent to said second side wall; and a sloped area between said first and second side edges, wherein said sloped area is angled downward toward the front wall of the base member;

wherein said shelf includes a top surface, an underside, and further comprises an upwardly projecting pour spout that includes an opening extending through the shelf; and wherein said lid includes a top surface and an underside.

2. The container of claim 1, wherein said side edges are flat.

3. The container of claim 2, wherein the angle of said sloped area relative to the side edges is greater than 180 degrees.

4. The container of claim 1, wherein said floor includes an underside with a frictional grip.

5. The container of claim 1, wherein said front wall of the base member includes an upper portion that is outwardly rounded to form a spout.

6. The container of claim 1, wherein the floor of the base member further includes an indentation to allow a user to insert one or more fingers therein.

7. The container of claim 1, wherein the base member includes a spout formed in a wall of the base member.

8. The container of claim 1, wherein the base member further includes first sidewall which is at least partially recessed toward the interior well and the second sidewall which is at least partially recessed toward the interior well, wherein the recessed areas of the first and second sidewall are adapted to accommodate the shelf.

9. The container of claim 1, wherein the base member further includes a back wall which is at least partially recessed toward the interior well of the base member in order that the back wall may accommodate the shelf.

10. The container of claim 8, wherein said recessed area includes at least one locking means for accepting the shelf.

11. The container of claim 9, wherein the recessed area includes at least one locking means for accepting the shelf.

12. The container of claim 1, wherein said container further comprises a handle.

13. The container of claim 12, wherein said handle is pivotally coupled to the first and second sidewalls of the base member.

14. The container of claim 1, wherein said base member further contains a fluid.

15. The container of claim 14, wherein said fluid is a paint.

16. The container of claim 10, wherein said recessed area is adapted to support the shelf.

17. The container of claim 1, wherein said shelf includes a first side lip that engages with a locking means on the first sidewall and a second side lip that engages with a locking means on the second sidewall to support the shelf.

18. The container of claim 1, wherein said shelf is adapted to be suspended within the base member above a fill level of a fluid.

19. The container of claim 14, wherein said fluid is at a fill level below the shelf.

20. The container of claim 1, wherein said shelf is adapted to receive a paint roller in contact therewith.

21. The container of claim 1, wherein the top surface of said shelf comprises at least one raised rib.

22. The container of claim 21, wherein said raised rib is a transverse rib.

23. The container of claim 1, wherein the top surface of said shelf comprises a series of raised ribs.

24. The container of claim 23, wherein said raised ribs are generally parallel.

25. The container of claim 1, wherein said underside of the shelf further includes at least one rib that extends through at least a portion of the length of the shelf.

26. The container of claim 1, wherein said underside of the shelf further includes at least one rib that extends the width of the shelf.

27. The container of claim 1, wherein the shelf is housed in a generally sloped angle within the base member.

28. The container of claim 1, wherein the shelf includes at least one gutter extending along at least a portion of the length of the shelf.

29. The container of claim 1, wherein the top surface of said shelf includes a first gutter extending at least a portion of the length of the shelf and a second gutter extending at least a portion of the length of the shelf.

30. The container of claim 29, wherein the top surface of the shelf includes at least one raised rib extending between said first gutter and said second gutter, wherein said raised rib is adjacent to said first gutter.

31. The container of claim 1, wherein the length of said shelf is no less than that length required to accommodate one compete revolution of a standard size paint roller.

32. The container of claim 1, wherein the length of said shelf is no more than that length required to provide an opening between said shelf and front wall of the base member.

33. The container of claim 1, wherein said shelf is longitudinally bowed.

34. The container of claim 1, wherein said shelf is permanently affixed into said base member.

35. The container of claim 1, wherein said shelf is removably affixed into said member.

36. The container of claim 1, wherein said pour spout includes at least one sidewall.

37. The container of claim 1, wherein said pour spout includes at least two adjacent sidewalls.

38. The container of claim 1, wherein the underside of said lid includes at least one projection therefrom.

39. The container of claim 38, wherein said projection abuts at least a portion of the top surface of the shelf when the lid is engaged onto the base member.

40. The container of claim 1, wherein the top surface of said lid includes at least a first flange.

41. The container of claim 40, wherein said flange extends upward at about 90° from the plane of the lid.

42. The container of claim 40, wherein said first flange lies between two opposing second and third flanges thereby creating a nesting area.

43. The container of claim 42, wherein said second and third flanges extend at about 90° from the plane of the lid.

44. The container of claim 43, wherein said nesting area of the lid has a generally level surface.

45. The container of claim 1, wherein said lid comprises an opening therethrough.

46. The container of claim 45, wherein said opening includes a removable plug that is affixed therein.

47. The container of claim 1, wherein said lid further comprises a nesting area adapted to receive another container.

48. The container of claim 45, wherein said nesting area of the lid has a generally level surface proximal to a first flange and a downward slope proximal to the front wall.

49. The container of claim 1, wherein said lid includes a sloped area.

50. The container of claim 1, wherein said container includes upper and a lower peripheral locking flanges, said upper and lower locking flanges having undersides for locking engagement with the lid, the lid comprising: a central portion and a peripheral skirt adapted to overlie the container locking flanges; the skirt defining a peripheral groove dividing said skirt into a skirt upper portion located adjacent to the container upper locking flange, and a lower tear-off strip portion located adjacent to the container lower locking flange; the skirt upper portion having inwardly disposed intermittent locking flange segments, adapted to engage the underside of the container upper locking flange; the skirt upper portion also being formed with a tab; and the tear-off strip portion defining an inwardly disposed locking flange adapted to engage the underside of the container lower locking flange, so that removal of the tear-off strip portion removes the lower locking flange.

51. The container of claim 50, further comprising a handle.

52. A container comprising:

a base member, wherein said base member comprises a first sidewall spaced from a second sidewall, a third sidewall spaced from a fourth sidewall and a floor, and wherein the first, second, third, and fourth sidewalls, and floor create an interior well, and wherein the first sidewall is at least partially recessed toward the interior well and the second sidewall is at least partially recessed toward the interior well;

a lid;

a handle pivotally mounted to the first sidewall and the second sidewall; and wherein said base member includes a shelf housed therein, wherein said shelf comprises an upwardly projecting pour spout having an opening extending through the shelf; and wherein said shelf extends from the first sidewall to the second sidewall.

53. The container of claim 52, wherein said shelf comprises at least one hole therethrough.

54. The container of claim 52, wherein said shelf comprises at least one gutter.

55. The container of claim 54, wherein said gutter extends at least part of the length of the shelf.

56. The container of claim 52, wherein said base member contains a fluid.

57. The container of claim 56, wherein said fluid is a paint.

58. The container of claim 52, wherein said shelf includes a first side lip, a second side lip and a back lip.

59. The container of claim 52, wherein said floor includes (1) a first side edge that is adjacent to the first sidewall of the base member; (2) a second side edge that is adjacent to the second sidewall of the base member, wherein said first and second side edge are a flat surface; and (3) a sloped central portion between said first and second side edge.

60. The container of claim 52, wherein the floor includes an underside surface with at least one caster attached thereto.

61. The container of claim 52, wherein the recessed portions of the first and second sidewall support said shelf.

62. The container of claim 52, wherein the shelf comprises at least one raised rib.

63. The container of claim 62, wherein said raised rib is lateral.

64. The container of claim 62, wherein the shelf comprises a plurality of raised ribs.

65. The container of claim 64, wherein said ribs arranged in a generally parallel relationship relative to one another.

66. The container of claim 52, wherein said shelf is a generally planar surface.

67. The container of claim 52, wherein said lid includes a topside with a first flange that is adjacent to a second flange, and wherein said second flange is adjacent to a third flange.

68. The container of claim 52, wherein said lid further includes a resealable opening therethrough.

69. The container of claim 68, wherein said resealable opening includes a plug affixed therein.

70. A applicator surface comprising:

at least one gutter extending at least a portion of the length of the shelf, wherein said gutter is oriented such that it directs the drainage of excess fluid into a container reservoir;

wherein said applicator surface includes a pouring spout that includes an opening extending through the shelf and wherein the applicator surface is positioned on sidewalls of a container.

71. The applicator surface of claim 70, wherein said surface is adapted to receive a paint roller in contact therewith.

72. The applicator surface of claim 70, wherein said container is adapted to receive said applicator surface.

73. The applicator surface of claim 70, wherein the length of said applicator surface is no less than that length required to accommodate one compete revolution of a standard size paint roller.

74. The applicator surface of claim 70, wherein said applicator surface is bowed.

75. The applicator surface of claim 70, wherein said applicator surface is suspended within the container.

76. The applicator surface of claim 70, wherein said applicator surface is permanently affixed into said container.

77. The applicator surface of claim 70, wherein said applicator surface is removably affixed into said container.

78. The applicator surface of claim 70, wherein said pouring spout is an upward projection.

79. The applicator surface of claim 70, wherein said pouring spout further includes at least one sidewall.

80. A container comprising:

a base member, wherein said base member comprises at least one side wall and a floor; and wherein said base member includes a shelf positioned on the side wall and which is suspended above the fill line of a liquid, and wherein said shelf includes an upwardly projecting pouring spout that extends through the shelf to create an opening through the shelf into the base member.

81. A container comprising:

a base member, wherein said base member forms a well comprising at least one side wall and a floor, and wherein the well further comprises a fluid contained therein; and wherein said base member includes a shelf housed on the sidewall therein, and wherein said shelf includes at least one gutter extending at least a portion of the length of the shelf, with the orientation of the gutter such that it directs drainage of the liquid into the well; and wherein said shelf further includes a spout that extends through the shelf thereby creating an opening through the shelf.

82. A container comprising:

a base member, wherein said base member comprises at least one sidewall and a floor and wherein said base member further includes a shelf that is housed therein on the sidewall, wherein said shelf includes a gutter extending at least a portion of the length of the shelf and oriented in a direction that facilitates drainage of a liquid into the base member and shelf further includes a pour spout that creates an opening through the shelf; and a lid.

83. A container comprising:

a base member, wherein said base member comprises at least one sidewall and a floor and wherein said base member further includes a shelf that is positioned on the sidewall of the base member and suspended therein above a fill line of the liquid, wherein said shelf includes a pour spout having an opening extending through the shelf; and a lid.

84. The process of applying paint to a roller including:

(1) providing a container with an opening into a fluid storage area;

(2) providing a shelf suspended over said fluid storage area, wherein said shelf includes an integrated pouring spout that creates an opening through the shelf and into the fluid storage area, and wherein said shelf is adapted to receive the roller thereon.

85. The process of applying paint to a roller including:

(1) providing a container with a least one sidewall and with an opening into a fluid storage area;

(2) providing a shelf suspended over said fluid storage area, wherein said shelf is positioned on the sidewall and wherein said shelf includes a gutter extending at least a portion of the length of the shelf and oriented in a direction that directs fluid toward the fluid storage area and said shelf further includes a spout that creates an opening through, the shelf.

86. A container comprising:

a base that includes at least one sidewall that forms a well;

a shelf that is housed on the sidewall within the base member, wherein said shelf comprises at least one gutter that extends at least a portion of the length of the shelf, and which is oriented to direct liquid into the well of the base, and wherein said shelf further includes a spout that extends through the shelf to create an opening through the shelf; and a lid.

87. A shelf comprising:

a pour spout, wherein said shelf is suspended within a container above the fill line of a liquid contained in the container, and wherein said shelf is adapted to receive a paint roller thereon, and wherein said spout includes a hole that extends through the shelf.

88. A container comprising:

a base member, wherein said base member comprises an interior well defined by at least one sidewall and a floor, and wherein the base member contains a liquid; and a roller surface that is suspended within the base member and is positioned in the sidewall, wherein said roller surface includes a pour spout wherein the opening of the spout extends through the roller surface, and wherein the roller surface is suspended above the fill line of a liquid.

89. A container comprising:

a base member, wherein said base member comprises an interior well defined by at least one sidewall and a floor; and a roller surface that is provided within the base member, wherein said roller surface includes a spout extending through the surface to create an opening through the surface, and wherein the roller surface further includes at least one gutter extending a portion of the length of the roller surface, wherein said gutter is oriented in a direction toward the well.

* * * * *